US006144354A

United States Patent [19]

Koyama et al.

[11] Patent Number: 6,144,354

[45] Date of Patent: Nov. 7, 2000

[54] IMAGE DISPLAY APPARATUS

[75] Inventors: Fumio Koyama; Keijiro Naito; Kiyoshi Miyashita, all of Suwa, Japan

[73] Assignee: Seiko Epson Corporation, Tokyo, Japan

[21] Appl. No.: 09/029,081

[22] PCT Filed: Jun. 20, 1997

[86] PCT No.: PCT/JP97/02127

§ 371 Date: Apr. 29, 1998

§ 102(e) Date: Apr. 29, 1998

[87] PCT Pub. No.: WO97/49080

PCT Pub. Date: Dec. 24, 1997

[51] Int. Cl.[7] ..... G09G 3/36

[52] U.S. Cl. ..... 345/98; 345/100

[58] Field of Search ..... 345/98, 99, 100, 345/87, 96, 204, 208, 209, 94

[56] References Cited

U.S. PATENT DOCUMENTS

| | | | |
|---|---|---|---|
| 5,170,158 | 12/1992 | Shinya | 345/98 |
| 5,369,417 | 11/1994 | Tanaka | 345/98 |
| 5,406,304 | 4/1995 | Shirayama | 345/98 |
| 5,973,661 | 10/1999 | Kobayashi et al. | 345/100 |

FOREIGN PATENT DOCUMENTS

| | | |
|---|---|---|
| 0 718 816 | 6/1996 | European Pat. Off. . |
| 0 789 345 | 8/1997 | European Pat. Off. . |
| 62-71932 | 4/1987 | Japan . |
| 62-116924 | 5/1987 | Japan . |
| 62-254123 | 11/1987 | Japan . |
| 64-35493 | 2/1989 | Japan . |
| 2-153391 | 6/1990 | Japan . |
| 3-248691 | 11/1991 | Japan . |
| 4-142513 | 5/1992 | Japan . |
| 6-222737 | 8/1994 | Japan . |
| 8-227065 | 9/1996 | Japan . |
| 9-134149 | 5/1997 | Japan . |

*Primary Examiner*—Regina Liang
*Attorney, Agent, or Firm*—Oliff & Berridge, PLC.

[57] ABSTRACT

To provide an image display apparatus in which, even if pixel data is phase-expanded, the influence of differences in circuit characteristic can be dispersed between frames. The apparatus has a phase expansion circuit 380 to which are input a first video signal A1 having pixel data for driving pixels with positive voltages and a second video signal $\overline{\mathbf{A2}}$ having pixel data for driving pixels with negative voltages. The phase expansion circuit 380 forms six phase-expanded signals V1 to V6 from the first and second video signals A1 and $\overline{\mathbf{A2}}$. The phase-expanded signals are expanded into pixel data by extending the data length of items of the pixel data corresponding to some of the pixels periodically selected. The phase expansion circuit 380 outputs the phase-expanded signals to phase-expanded signal output lines in parallel with each other. The apparatus also has a connection change circuit 390 for changing connections between six phase-expanded signal output lines 388*a* to 388*f* and six signal supply lines 132*a* to 132*f*. Change of the order of expansion into six phase-expanded signals V1 to V6 by the phase expansion means and change of the combination of connections changed by the connection change circuit 390 while being linked to the expansion order are controlled by a timing generation circuit block 200. This timing generation circuit block 220 performs change control so that a expansion order first set with respect to the preceding frame is changed to a different expansion order in synchronization with vertical synchronization.

14 Claims, 23 Drawing Sheets

FIG. 7

FRAME 1

| | | | | | | | | | | |
|---|---|---|---|---|---|---|---|---|---|---|
| V1+ | V2- | V3+ | V4- | V5+ | V6- | V1+ | V2- | --------- | V1+ | V2- |
| V2- | V3+ | V4- | V5+ | V6- | V1+ | V2- | V3+ | | V2- | V3+ |
| V3+ | V4- | V5+ | V6- | V1+ | V2- | V3+ | V4- | | V3+ | V4- |
| V4- | V5+ | V6- | V1+ | V2- | V3+ | V4- | V5+ | | V4- | V5+ |
| ⋮ | | | | | | | | | | |
| V6- | V1+ | V2- | V3+ | V4- | V5+ | V6- | V1+ | | V6- | V1+ |

FRAME 2

| | | | | | | | | | | |
|---|---|---|---|---|---|---|---|---|---|---|
| V1- | V2+ | V3- | V4+ | V5- | V6+ | V1- | V2+ | --------- | V1- | V2+ |
| V2+ | V3- | V4+ | V5- | V6+ | V1- | V2+ | V3- | | V2+ | V3- |
| V3- | V4+ | V5- | V6+ | V1- | V2+ | V3- | V4+ | | V3- | V4+ |
| V4+ | V5- | V6+ | V1- | V2+ | V3- | V4+ | V5- | | V4+ | V5- |
| ⋮ | | | | | | | | | | |
| V6+ | V1- | V2+ | V3- | V4+ | V5- | V6+ | V1- | | V6+ | V1- |

FIG. 8

FRAME 1

| | | | | | | | | | | |
|---|---|---|---|---|---|---|---|---|---|---|
| V1+ | V2+ | V3+ | V4+ | V5+ | V6+ | V1+ | V2+ | --------- | V1+ | V2+ |
| V2- | V3- | V4- | V5- | V6- | V1- | V2- | V3- | | V2- | V3- |
| V3+ | V4+ | V5+ | V6+ | V1+ | V2+ | V3+ | V4+ | | V3+ | V4+ |
| V4- | V5- | V6- | V1- | V2- | V3- | V4- | V5- | | V4- | V5- |
| ⋮ | | | | | | | | | | |
| V6- | V1- | V2- | V3- | V4- | V5- | V6- | V1- | | V6- | V1- |

FRAME 2

| | | | | | | | | | | |
|---|---|---|---|---|---|---|---|---|---|---|
| V1- | V2- | V3- | V4- | V5- | V6- | V1- | V2- | --------- | V1- | V2- |
| V2+ | V3+ | V4+ | V5+ | V6+ | V1+ | V2+ | V3+ | | V2+ | V3+ |
| V3- | V4- | V5- | V6- | V1- | V2- | V3- | V4- | | V3- | V4- |
| V4+ | V5+ | V6+ | V1+ | V2+ | V3+ | V4+ | V5+ | | V4+ | V5+ |
| ⋮ | | | | | | | | | | |
| V6+ | V1+ | V2+ | V3+ | V4+ | V5+ | V6+ | V1+ | | V6+ | V1+ |

FIG. 9

FRAME 1

| | | | | | | | | | | |
|---|---|---|---|---|---|---|---|---|---|---|
| V1+ | V2+ | V3+ | V4+ | V5+ | V6+ | V1+ | V2+ | --------- | V1+ | V2+ |
| V2+ | V3+ | V4+ | V5+ | V6+ | V1+ | V2+ | V3+ | | V2+ | V3+ |
| V3+ | V4+ | V5+ | V6+ | V1+ | V2+ | V3+ | V4+ | | V3+ | V4+ |
| V4+ | V5+ | V6+ | V1+ | V2+ | V3+ | V4+ | V5+ | | V4+ | V5+ |
| ⋮ | | | | | | | | | | |
| V6+ | V1+ | V2+ | V3+ | V4+ | V5+ | V6+ | V1+ | | V6+ | V1+ |

FRAME 2

| | | | | | | | | | | |
|---|---|---|---|---|---|---|---|---|---|---|
| V1- | V2- | V3- | V4- | V5- | V6- | V1- | V2- | --------- | V1- | V2- |
| V2- | V3- | V4- | V5- | V6- | V1- | V2- | V3- | | V2- | V3- |
| V3- | V4- | V5- | V6- | V1- | V2- | V3- | V4- | | V3- | V4- |
| V4- | V5- | V6- | V1- | V2- | V3- | V4- | V5- | | V4- | V5- |
| ⋮ | | | | | | | | | | |
| V6- | V1- | V2- | V3- | V4- | V5- | V6- | V1- | | V6- | V1- |

FIG. 10

FRAME 1

| | | | | | | | | | | |
|---|---|---|---|---|---|---|---|---|---|---|
| V1+ | V2- | V3+ | V4- | V5+ | V6- | V1+ | V2- | --------- | V1+ | V2- |
| V2- | V3+ | V4- | V5+ | V6- | V1+ | V2- | V3+ | | V2- | V3+ |
| V3+ | V4- | V5+ | V6- | V1+ | V2- | V3+ | V4- | | V3+ | V4- |
| V4- | V5+ | V6- | V1+ | V2- | V3+ | V4- | V5+ | | V4- | V5+ |
| ⋮ | | | | | | | | | | |
| V6- | V1+ | V2- | V3+ | V4- | V5+ | V6- | V1+ | | V6- | V1+ |

FRAME 2

| | | | | | | | | | | |
|---|---|---|---|---|---|---|---|---|---|---|
| V2- | V3+ | V4- | V5+ | V6- | V1+ | V2- | V3+ | --------- | V2- | V3+ |
| V3+ | V4- | V5+ | V6- | V1+ | V2- | V3+ | V4- | | V3+ | V4- |
| V4- | V5+ | V6- | V1+ | V2- | V3+ | V4- | V5+ | | V4- | V5+ |
| V5+ | V6- | V1+ | V2- | V3+ | V4- | V5+ | V6- | | V5+ | V6- |
| ⋮ | | | | | | | | | | |
| V6- | V1+ | V2- | V3+ | V4- | V5+ | V6- | V1+ | | V6- | V1− |

FIG. 11

FRAME 1

| | | | | | | | | | | |
|---|---|---|---|---|---|---|---|---|---|---|
| a1+ | a2− | a3+ | a4− | a5+ | a6− | a7+ | a8− | --------- | $a_{k-1}$+ | $a_k$ − |
| b1− | b2+ | b3− | b4+ | b5− | b6+ | b7− | b8+ | | $b_{k-1}$ − | $b_k$ + |
| c1+ | c2− | c3+ | c4− | c5+ | c6− | c7+ | c8− | | $c_{k-1}$ + | $c_k$ − |
| d1− | d2+ | d3− | d4+ | d5− | d6+ | d7− | d8+ | | $d_{k-1}$ − | $d_k$ + |
| ⋮ | | | | | | | | | | |
| | | | | | | | | | | |

FRAME 2

| | | | | | | | | | | |
|---|---|---|---|---|---|---|---|---|---|---|
| a1− | a2+ | a3− | a4+ | a5− | a6+ | a7− | a8+ | --------- | $a_{k-1}$ − | $a_k$ + |
| b1+ | b2− | b3+ | b4− | b5+ | b6− | b7+ | b8− | | $b_{k-1}$ + | $b_k$ − |
| c1− | c2+ | c3− | c4+ | c5− | c6+ | c7− | c8+ | | $c_{k-1}$ − | $c_k$ + |
| d1+ | d2− | d3+ | d4− | d5+ | d6− | d7+ | d8− | | $d_{k-1}$ + | $d_k$ − |
| ⋮ | | | | | | | | | | |
| | | | | | | | | | | |

FIG. 12

FRAME 1

| | | | | | | | | | | |
|---|---|---|---|---|---|---|---|---|---|---|
| a1+ | a2+ | a3+ | a4+ | a5+ | a6+ | a7+ | a8+ | --------- | $a_{k-1}$+ | $a_k$ + |
| b1− | b2− | b3− | b4− | b5− | b6− | b7− | b8− | | $b_{k-1}$ − | $b_k$ − |
| c1+ | c2+ | c3+ | c4+ | c5+ | c6+ | c7+ | c8+ | | $c_{k-1}$ + | $c_k$ + |
| d1− | d2− | d3− | d4− | d5− | d6− | d7− | d8− | | $d_{k-1}$ − | $d_k$ − |
| ⋮ | | | | | | | | | | |
| | | | | | | | | | | |

FRAME 2

| | | | | | | | | | | |
|---|---|---|---|---|---|---|---|---|---|---|
| a1− | a2− | a3− | a4− | a5− | a6− | a7− | a8− | --------- | $a_{k-1}$ − | $a_k$ − |
| b1+ | b2+ | b3+ | b4+ | b5+ | b6+ | b7+ | b8+ | | $b_{k-1}$ + | $b_k$ + |
| c1− | c2− | c3− | c4− | c5− | c6− | c7− | c8− | | $c_{k-1}$ − | $c_k$ − |
| d1+ | d2+ | d3+ | d4+ | d5+ | d6+ | d7+ | d8+ | | $d_{k-1}$ − | $d_k$ − |
| ⋮ | | | | | | | | | | |
| | | | | | | | | | | |

FIG. 13

FRAME 1

| | | | | | | | | | | |
|---|---|---|---|---|---|---|---|---|---|---|
| a1+ | a2+ | a3+ | a4+ | a5+ | a6+ | a7+ | a8+ | --------- | $a_{k-1}$+ | $a_k$ + |
| b1+ | b2+ | b3+ | b4+ | b5+ | b6+ | b7+ | b8+ | | $b_{k-1}$+ | $b_k$ + |
| c1+ | c2+ | c3+ | c4+ | c5+ | c6+ | c7+ | c8+ | | $c_{k-1}$+ | $c_k$ + |
| d1+ | d2+ | d3+ | d4+ | d5+ | d6+ | d7+ | d8+ | | $d_{k-1}$+ | $d_k$ + |
| ⋮ | | | | | | | | | | |
| | | | | | | | | | | |

FRAME 2

| | | | | | | | | | | |
|---|---|---|---|---|---|---|---|---|---|---|
| a1− | a2− | a3− | a4− | a5− | a6− | a7− | a8− | --------- | $a_{k-1}$− | $a_k$ − |
| b1− | b2− | b3− | b4− | b5− | b6− | b7− | b8− | | $b_{k-1}$− | $b_k$ − |
| c1− | c2− | c3− | c4− | c5− | c6− | c7− | c8− | | $c_{k-1}$ − | $c_k$ − |
| d1− | d2− | d3− | d4− | d5− | d6− | d7− | d8− | | $d_{k-1}$ − | $d_k$ − |
| ⋮ | | | | | | | | | | |
| | | | | | | | | | | |

FIG. 18

| SELECT SIGNAL | PANEL DRIVE VIDEO SIGNAL V(i) | | | | | |
|---|---|---|---|---|---|---|
| | 1 | 2 | 3 | 4 | 5 | 6 |
| S1 | V (1) | V (2) | V (3) | V (4) | V (5) | V (6) |
| S2 | V (6) | V (1) | V (2) | V (3) | V (4) | V (5) |
| S3 | V (5) | V (6) | V (1) | V (2) | V (3) | V (4) |
| S4 | V (4) | V (5) | V (6) | V (1) | V (2) | V (3) |
| S5 | V (3) | V (4) | V (5) | V (6) | V (1) | V (2) |
| S6 | V (2) | V (3) | V (4) | V (5) | V (6) | V (1) |

FIG. 20

| | | | | | | | | | |
|---|---|---|---|---|---|---|---|---|---|
| V1(1) | V1(2) | V1(3) | V1(4) | V1(5) | V1(6) | V1(1) | V1(2) | V1(3) ----- | 1ST LINE |
| V1(6) | V1(1) | V1(2) | V1(3) | V1(4) | V1(5) | V1(6) | V1(1) | V1(2) ----- | 2ND LINE |
| V1(5) | V1(6) | V1(1) | V1(2) | V1(3) | V1(4) | V1(5) | V1(6) | V1(1) ----- | 3RD LINE |
| V1(4) | V1(5) | V1(6) | V1(1) | V1(2) | V1(3) | V1(4) | V1(5) | V1(6) ----- | 4TH LINE |
| V1(3) | V1(4) | V1(5) | V1(6) | V1(1) | V1(2) | V1(3) | V1(4) | V1(5) ----- | 5TH LINE |

NEXT PICTURE

| | | | | | | | | | |
|---|---|---|---|---|---|---|---|---|---|
| V1(6) | V1(1) | V1(2) | V1(3) | V1(4) | V1(5) | V1(6) | V1(1) | V1(2) ----- | 1ST LINE |
| V1(5) | V1(6) | V1(1) | V1(2) | V1(3) | V1(4) | V1(5) | V1(6) | V1(1) ----- | 2ND LINE |
| V1(4) | V1(5) | V1(6) | V1(1) | V1(2) | V1(3) | V1(4) | V1(5) | V1(6) ----- | 3RD LINE |
| V1(3) | V1(4) | V1(5) | V1(6) | V1(1) | V1(2) | V1(3) | V1(4) | V1(5) ----- | 4TH LINE |
| V1(2) | V1(3) | V1(4) | V1(5) | V1(6) | V1(1) | V1(2) | V1(3) | V1(4) ----- | 5TH LINE |

V1(1) DARKER PIXEL

IMAGE DISPLAY APPARATUS

BACKGROUND OF THE INVENTION

1. Field of Invention

The present invention relates to an image display apparatus using a liquid crystal panel or the like and, more particularly, to an image display apparatus capable of reducing deterioration in image quality due to a non-uniformity of elements while using phase-expanded pixel signals. The present invention also relates to an image display apparatus in which, if an input signal is a digital signal, polarity inversion and phase expansion of the digital signal are executed and digital-to-analog conversion or the like is performed at a low rate. Further, the present invention relates to an image display apparatus which is capable of executing phase expansion a certain number of times at the stages a digital signal and analog signal processed after the digital signal.

2. Description of Related Art

An image display apparatus is known which uses a liquid crystal display panel in which a data-side drive circuit and a scanning-side drive circuit are constituted of thin film transistors (TFTs). In this image display apparatus, matching is necessary between a frequency of a video signal and an operating speed when the video signal is sampled.

Then, a process is conceivable in which pixel signals contained as serial data in the video signal are phase-expanded and a display is made by using the phase-expanded pixel signals. That is, as shown in FIGS. 22A and 22B, a phase expansion circuit 30 for expanding a video signal VIDEO in six phases is provided in a block 10 of a pixel display apparatus. Panel drive video signals V(i) (i=1 to 6) in these phases are respectively output from six output terminals OUT1 to OUT6 in accordance with a control signal from a timing circuit block 20. Panel drive video signals V(i) are supplied to groups of data signal lines 112 of a liquid crystal panel 110 each corresponding to a row of six pixels in the horizontal direction via sampling switches 134 connected to signal supply lines 132. Panel drive video signals V(i) are video signals expanded in six phases from input video signal VIDEO by the phase expansion circuit 30. Therefore, each panel drive video signal V(i) contains pixel signals for every sixth pixel, and the frequency of the panel drive video signal V(i) is lower than the frequency of input video signal VIDEO. As a result, even if the operating speeds of the data-side drive circuit 130 and the scanning-side drive circuit 120, constituted of thin film transistors, are low, the data-side drive circuit 130 can reliably sample, with the sampling switches 134, pixel signal PD corresponding to each data signal line 112 from panel drive video signals V(1) to V(6) supplied to terminals VIN1 to VIN6 in accordance with sampling signals supplied from a shift register 136 for driving the sampling switches 134.

There is also a need to drive the liquid crystal panel by an alternating current signal. Therefore, the polarity of the liquid crystal drive video signal is always changed. Polarity inverting drive per dot is more effective in improving and stabilizing image qualities than polarity inverting drive per frame or polarity inverting drive per line.

Then, according to conventional art, as shown in FIG. 23, a polarity inversion circuit 40 is formed in a stage before the phase expansion circuit 30. In the polarity inversion circuit 40, a signal output circuit 42 forms two video signals inverse in polarity from the input video signal VIDEO and outputs these signals, and selectors 44*a* and 44*b*, formed of analog switches, change the polarity of the video signal supplied to each of the sample and hold circuits of the phase expansion circuit 30.

In the conventional image display apparatus, however, the phase expansion circuit 30 is provided with the circuits corresponding to the phases and these circuits may have different gains or offsets due to variations in their characteristics, changes with time of their component parts, or their mounted conditions, even though they have the same circuit configuration. Therefore, even if input video signal VIDEO has pixel signals PD uniform in brightness, there is a possibility of the pixel signals PD having different intensities with respect to the phases after phase expansion. The problem in such a case is that some of the pixels which are to be equal in brightness on the liquid crystal panel 110 will be displayed with different degrees of brightness. That is, if panel drive video signal V(i) having an abnormal intensity is supplied to some data signal line 112 in each group of six data signal lines 112, the corresponding difference in brightness appears as a vertical line on the liquid crystal panel 110.

Moreover, in the conventional image display apparatus, the selectors 44*a* and 44*b* handle video signals at high frequencies. However, the frequency of a video signal may be so high that they hardly follow up the signal. Therefore, when a display is made by using phase-expanded video signals, adaptation to video signals having certain high frequencies is impossible particularly if the display is a one-dot polarity inverting display.

SUMMARY OF THE INVENTION

The present invention has been developed to solve the above-described problems, and an object of the present invention is to provide a video display apparatus which is adapted to the input of a high-frequency image by phase expansion, and which is arranged so that, even if variations in gain or offsets occur in circuits due to variations in characteristics or changes with time of component parts, or mounted conditions of the circuits while the circuits have the same configuration, the influence of variations in characteristics of the circuits on the displayed picture with respect to phases can be reduced.

Another object of the present invention is to provide a video display apparatus which is capable of performing signal processing without using a circuit adapted to high frequencies, even if an image having a high frequency is input, while still maintaining a small size and low price.

Still another object of the present invention is to provide a video display apparatus which is capable of performing polarity inversion and phase expansion of a digital signal as well as digital-to-analog conversion at a low rate if a digital signal is input.

According to one aspect of the present invention, there is provided an image display apparatus having:

- an image display unit in which pixels electrically connected to a plurality of data signal lines and to a plurality of scanning signal lines are arrayed in a matrix form; and
- scanning signal line selection means for supplying the scanning signal lines with scanning signals for successively selecting the scanning signal lines,
- the apparatus driving the pixels by applying voltages to the pixels in accordance with the data signals and the scanning signals while inverting the polarities of the voltages applied to the pixels, the apparatus comprising:
  - phase expansion means supplied with a first video signal having serial pixel data for driving the pixels by voltages having a first polarity, and with a second video signal having serial pixel data for driving the pixels by voltages having a second polarity, the phase expansion means forming, from the first and second video signals, m (where m is an integer equal to or larger than 2) phase-expanded signals expanded into pixel data by extending the data length of items of the pixel data corresponding to some of the pixels periodically selected, the phase expansion means outputting the phase-expanded signals to phase-expanded signal output lines in parallel with each other;

signal supply means for supplying the pixel data to the plurality of data lines on the basis of the m phase-expanded signals input via m signal supply lines;

connection change means for changing connections between the m phase-expanded signal output lines and the m signal supply lines; and change control means for controlling change of the order of expansion into the m phase-expanded signals performed by the phase expansion means, and a combination of connections changed by the connection change means by linking the combination to the expansion order, wherein the change control means performs change control so that an expansion order first set with respect to the preceding frame is changed to a different expansion order in synchronization with vertical synchronization.

According to the present invention, the order of phase expansion by the phase expansion means is changed and, as compensation for a change in the sequence of serial pixel data thereby caused, a connection change is made by the connection change means, thereby enabling the serial pixel data to be always supplied to the predetermined pixels to display the image. At this time, the phase expansion means changes the expansion order first set with respect to the preceding frame to a different expansion order in synchronization with vertical synchronization, so that the positions of deterioration in image quality due to a characteristic difference between circuits are dispersed in one frame and are also dispersed with respect to another frame. Therefore, the problem of a characteristic difference between circuits or the like as seen with the eye is thereby made negligible, thus achieving an improvement in image quality. Moreover, a characteristic margin of circuit components is increased to enable the image display apparatus to be manufactured at a low cost.

According to the present invention, two video signals previously fixed in polarity may be input, and it is not always necessary to change signals having first and second polarities with analog switches or the like. Therefore, the present invention is also suitable for processing of a high-frequency image.

The above-described change control means may control change of the expansion order between at least m expansion orders in accordance with a predetermined sequence and in synchronization with horizontal synchronization.

Thus, the order of phase expansion in one frame is changed in accordance with a predetermined sequence and in synchronization with horizontal synchronization to disperse the influence of a difference in characteristic between circuits. Also, change of the expansion order and change of connections necessarily changed with the expansion order can easily be controlled in accordance with the sequence.

The above-described change control means may form the m expansion signals by alternately expanding the pixel data of the first and second video signals.

If this is done, the polarities of the first and second video signals are made opposite from each other, thereby facilitating realization of a dot inverting drive.

The above-described phase expansion means may have m sample and hold sections connected to the m phase-expanded signal output lines, the first video signal being constantly input to one of two groups of the sample and hold sections, the second video signal being constantly input to the other group of the sample and hold sections.

The first and second video signals are thereby input constantly to the particular sample and hold circuits, so that the apparatus can be adapted for high-frequency images without requiring selectors or analog switches in a stage before the phase expansion means.

According to another aspect of the present invention, there is provided an image display apparatus having:

an image display unit in which pixels electrically connected to a plurality of data signal lines and to a plurality of scanning signal lines are arrayed in a matrix form;

scanning signal line selection means for supplying the scanning signal lines with scanning signals for successively selecting the scanning signal lines; and signal supply means for supplying pixel data signals to the plurality of data signal lines, the apparatus driving the pixels by applying voltages to the pixels in accordance with the data signals and the scanning signals while inverting the polarities of the voltages applied to the pixels, the apparatus comprising:

first phase expansion means supplied with a digital signal having pixel data of a first data length corresponding to the position of each of the pixels, the first phase expansion means outputting two phase-expanded digital signals in which items of the pixel data corresponding to some of the pixels periodically selected are expanded into pixel data having a data length n (where n is an integer equal to or larger than 2) times longer than the first data length;

first and second branching means respectively supplied with the phase-expanded digital signals, each of the first and second branching means branching a route for the phase-expanded digital signal into a first route on which the polarity of the digital signal is not inverted and a second route on which the polarity of the digital signal is inverted by polarity inversion means;

first selection means for selecting one of the first and second routes branched by the first branching means;

second selection means for selecting one of the first and second routes branched by the second branching means; and first and second digital-to-analog conversion means for respectively analog-to-digital converting the two phase-expanded digital signals selected by the first and second selection means to output two first phase-expanded analog signals, wherein the signal supply means supplies the pixel data signals to the data signal lines on the basis of the two first phase-expanded analog signals.

According to this invention, the pixel data of the digital signal is phase-expanded and the frequency of the digital signal is thereby reduced, so that the sampling frequency of the subsequent first and second digital-to-analog conversion means can be reduced to enable adaptation for high-frequency images. Also, the two phase-expanded digital signals are branched into four to form signals having different polarities, and two of these signals are selected, thus enabling universal use for various polarity inverting drives.

According to still another aspect of the present invention, there is provided an image display apparatus having:

an image display unit in which pixels electrically connected to a plurality of data signal lines and to a plurality of scanning signal lines are arrayed in a matrix form;

scanning signal line selection means for supplying the scanning signal lines with scanning signals for successively selecting the scanning signal lines; and signal supply means for supplying pixel data signals to the plurality of data signal lines, the apparatus driving the pixels by applying voltages to the pixels in accordance with the data signals and the scanning signals while inverting the polarities of the voltages applied to the pixels, the apparatus comprising:

first phase expansion means supplied with a digital signal having pixel data of a first data length corresponding to the position of each of the pixels, the first phase expansion means outputting two phase-expanded digital signals in which items of the pixel data corresponding to some of the pixels periodically selected are expanded into pixel data having a data length n (where n is an integer equal to or larger than 2) times longer than the first data length;

polarity determination means supplied with the two phase-expanded digital signals, the polarity determination means determining the polarities of the two phase-expanded digital signals by leading one of the phase-expanded digital signals to a first route on which the polarity of the digital signal is not inverted and leading the other of the phase-expanded digital signals to a second route on which the polarity of the digital signal is inverted by polarity inversion means;

first and second digital-to-analog conversion means for respectively analog-to-digital converting the two phase-expanded digital signals having the determined polarities to output two first phase-expanded analog signals, wherein the signal supply means supplies the pixel data signals to the data signal lines on the basis of the two first phase-expanded analog signals.

According to this invention, the polarities of the two phase-expanded digital signals are determined by a polarity determination circuit. Then, polarity inverting drive in the frame cycle only becomes impossible and the number of kinds of usable polarity inverting drive is reduced. However, frequently demanded dot inverting and line inverting can be performed and the number of circuits is markedly reduced.

The apparatus may further comprise second phase expansion means for forming, from the two first phase-expanded analog signals, n X N (where N is an integer) second phase-expanded analog signals expanded into pixel data by extending the data length of items of the pixel data corresponding to some of the pixels periodically selected, the second phase expansion means outputting the second phase-expanded analog signals to n X N phase-expanded signal output lines in parallel with each other. In this case, the signal supply means supplies the pixel data signals to the data signal lines on the basis of the n X N second phase-expanded analog signals.

In this manner, phase expansion of the desired number of phases is executed by being separately performed two times as the first phase expansion of the digital signal and the second phase expansion of the analog signals. Since the frequency of the digital signal is reduced by the first phase expansion, the frequency of a clock for digital-to-analog conversion and so on necessary before the second phase expansion can be reduced to enable adaptation for high-frequency images.

The above-described signal supply means may supply the pixel data to the plurality of data signal lines on the basis of the n X N second phase-expanded analog signals input through n X N signal supply lines.

In this case, preferably, the apparatus further comprises connection change means for changing connections between the n X N phase-expanded signal output line and the n X N signal supply lines; and change control means for controlling change of the order of phase expansion performed by each of the first and second phase expansion means, and a combination of connections changed by the connection change means by linking the combination to the phase expansion order.

According to this arrangement, the order of phase expansion by the phase expansion means is changed and, as compensation for a change in the sequence of serial pixel data thereby caused, a connection change is made by the connection change means, thereby enabling the serial pixel data to be always supplied to the predetermined pixels to display the image. Also, by changing the expansion order of the first and second phase expansions, the influence of different circuit characteristics on image qualities can be reduced.

A first-polarity gamma correction circuit and a first-polarity clamp circuit may be connected in a stage subsequent to the first digital-to-analog conversion means, and a second-polarity gamma correction circuit and a second-polarity clamp circuit may be connected in a stage subsequent to the second digital-to-analog conversion means.

In this case, a gamma correction circuit and a clamp circuit having one of the first and second polarities may suffice for one signal line, thereby reducing the number of circuits.

The above-described change control means may control the first and second phase expansion means and the connection change means by selecting at least one of predetermined n X N phase expansion orders for the first and second phase expansion means, and by also selecting one of a plurality of predetermined combinations of connections as the combination of connections changed by the connection change means.

The contents of the control performed by change controls means are simplified thereby.

The above-described change control means may control change of the order of phase expansion performed by the first and second phase expansion means and the combination of connections changed by the connection change means so that the voltages applied to the pixels differ in polarity one from another with respect to the pixels connected in common to each of the scanning signal lines.

A dot inverting drive on each scanning line is thereby enabled.

The above-described change control means may control change of the order of phase expansion performed by the first and second phase expansion means and the combination of connections changed by the connection change means so that the voltages applied to the pixels are changed in polarity one from another in synchronization with a horizontal synchronization signal with respect to the pixels connected in common to each of the data lines.

A line inverting drive on each data line is thereby enabled.

The above-described change control means may control change of the order of phase expansion performed by the first and second phase expansion means and the combination of connections changed by the connection change means so that the data sampling section in which data of the leading pixel of one frame is sampled is changed with respect to frames in synchronization with a vertical synchronization signal.

In this manner, bad influences of circuit characteristics can also be dispersed between frames.

The present invention can suitably applied to image display apparatuses, such as a liquid crystal panel and a liquid crystal projector, for which a polarity inversion drive is indispensable considering the life of the liquid crystal.

BRIEF DESCRIPTION OF THE DRAWINGS

FIG. 7 is a schematic explanatory diagram in which outputs of sample and hold circuits shown in FIG. 2 at the time of dot inverting drive are rearranged at pixel positions.

FIG. 8 is a schematic explanatory diagram in which outputs of the sample and hold circuits shown in FIG. 2 at the time of line inverting drive are rearranged at pixel positions.

FIG. 9 is a schematic explanatory diagram in which outputs of the sample and hold circuits shown in FIG. 2 at the time of frame inverting drive are rearranged at pixel positions.

FIG. 10 is a schematic explanatory diagram in which outputs of the sample and hold circuits shown in FIG. 2 when phase expansion are performed by the sample and hold circuits so that the pixel data with the leading addresses differ from each other between frames are rearranged at pixel positions.

FIG. 11 is a schematic explanatory diagram showing polarities of pixel data at the time of dot inverting drive achieved by the drive shown in FIG. 7 or 10.

FIG. 12 is a schematic explanatory diagram showing polarities of pixel data at the time of line inverting drive achieved by the drive shown in FIG. 8.

FIG. 13 is a schematic explanatory diagram showing polarities of pixel data at the time of frame inverting drive achieved by the drive shown in FIG. 9.

FIG. 18 is a characteristic diagram for explanation of the relationship between panel drive signal V(i) and video signal V1(i) in the data processing block shown in FIG. 17.

FIG. 20 is a diagram showing the state of a display made by the select signals shown in FIG. 19.

DETAILED DESCRIPTION OF PREFERRED EMBODIMENTS

Embodiments of the present invention will be described with reference to the drawings.

First Embodiment

Figure 1:
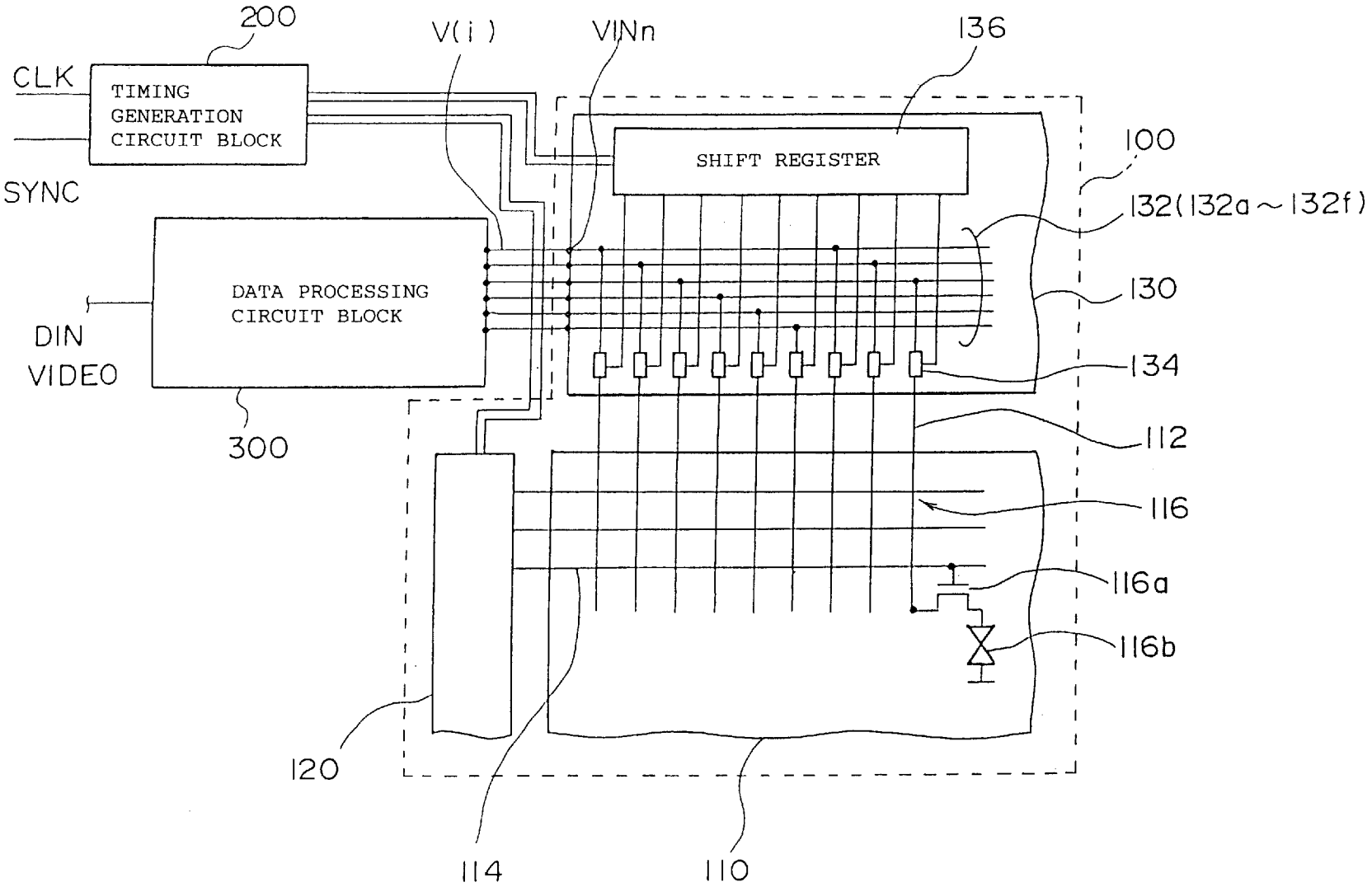
FIG. 1 is a block diagram showing an example of an image display apparatus to which the present invention is applied.

FIG. 1 schematically shows an image display apparatus to which the present invention has been applied. In the following description, elements having the functions common to this image display apparatus and the image display apparatus described above with reference to FIG. 6 are shown with the same reference characters.

Referring to FIG. 1, the image display apparatus is a display apparatus of a type using an active matrix type liquid crystal panel 110, and is constituted mainly of a liquid crystal panel block 100, a timing generation circuit block 200 and a data processing circuit block 300.

The liquid crystal panel block 100 has, on the same glass substrate, a liquid crystal panel 10, which is an image display unit, a scanning-side drive circuit 120, which is a scanning signal line selection means, and a data-side drive circuit 130, which is a signal supply means.

In the liquid crystal panel 10, pixels 116 connected to a plurality of data signal lines 112 and to a plurality of scanning signal lines 114 are arrayed in matrix form. Each pixel 116 is formed of a switching element, e.g., a thin film transistor (TFT) 116*a* and a liquid crystal layer 116*b*. Switching element 116*a* is not limited to a threeterminal element represented by TFT and may alternatively be a two-terminal element represented by a metal layer-insulating layer-metal layer (MIM) element. An application of the present invention, to drive a liquid crystal panel, the kind of liquid crystal panel is not limited to the above-described active matrix panel and may also be a simple matrix liquid crystal panel, and switching element 116*a* is not always necessary.

The scanning-side drive circuit 120 supplies scanning signals to the scanning signal lines 114 to successively select the scanning signal lines 114.

The data-side drive circuit 130 has, for example, six signal supply lines 132, a plurality of sampling switches 134 connected between the six signal supply lines 132 and the plurality of data signal lines 112, and a shift register 136 which outputs signals to the sampling switches 134 to determine sampling timing.

The timing generation block 200 is arranged to supply various timing signals to the liquid crystal panel block 100 and to the data processing circuit block 300. Details of the timing generation block 200 will be described later.

Figure 2:
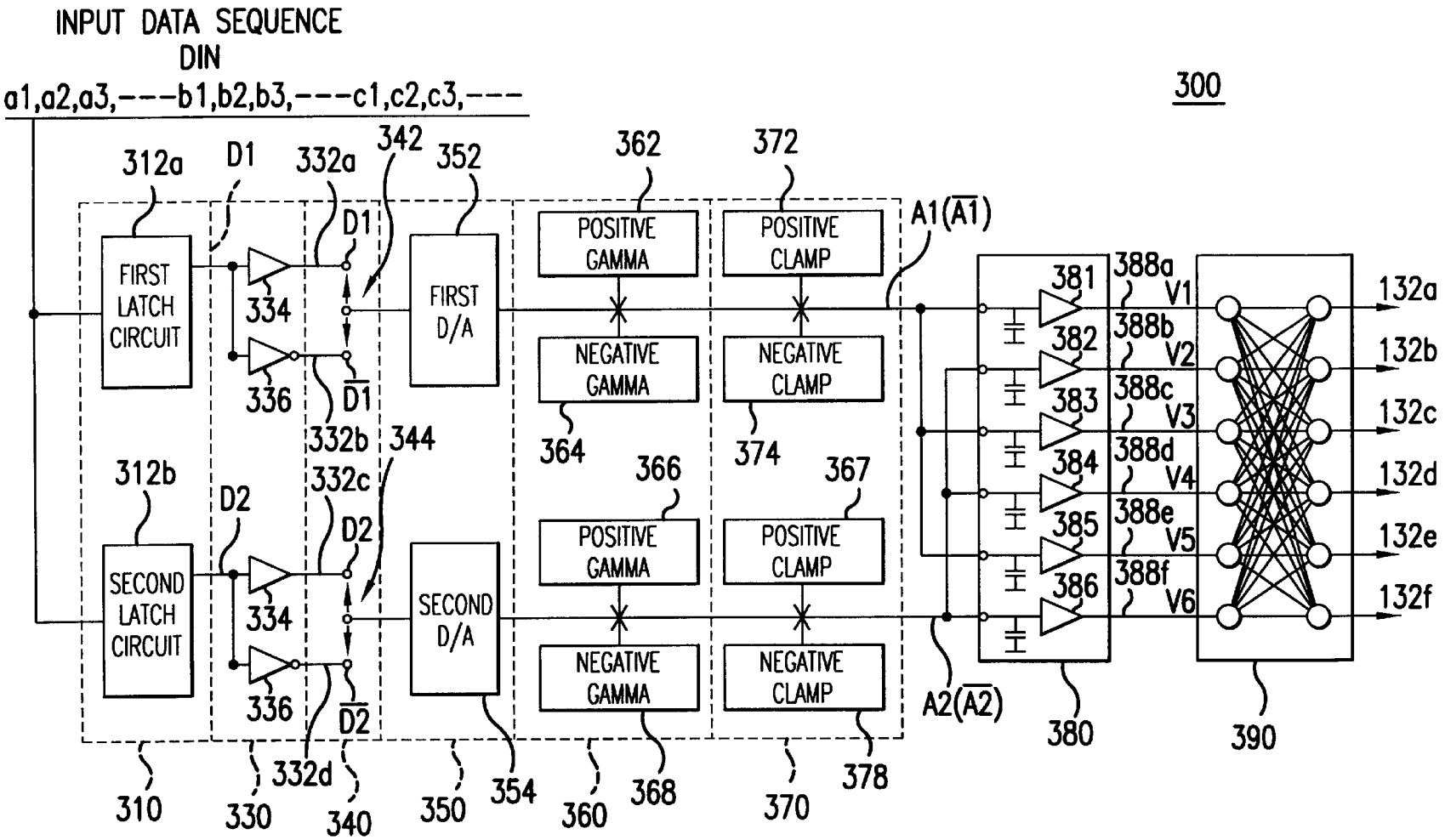
FIG. 2 is a block diagram showing details of a data processing circuit block of the image display apparatus shown in FIG. 1.

As shown in FIG. 2, the data processing circuit block 300 has, as its main constituents, a first phase expansion circuit 310, a branching circuit 330, a selection circuit 340, a digital-to-analog conversion circuit 350, a gamma correction circuit 360, a clamp circuit 370, a second phase expansion circuit 380, and a connection change circuit (rotation circuit) 390.

The configuration of the data processing block 300 will be described in more detail along with the operation thereof.

To the first phase expansion circuit 310 are input, for example, digital pixel data a1, a2, a3 . . . to be supplied to pixels 116 connected to the first-line scanning signal line 114 and digital pixel data b1, b2, b3 . . . to be supplied to second-line pixels 116, as shown in FIG. 2.

Figure 3A:
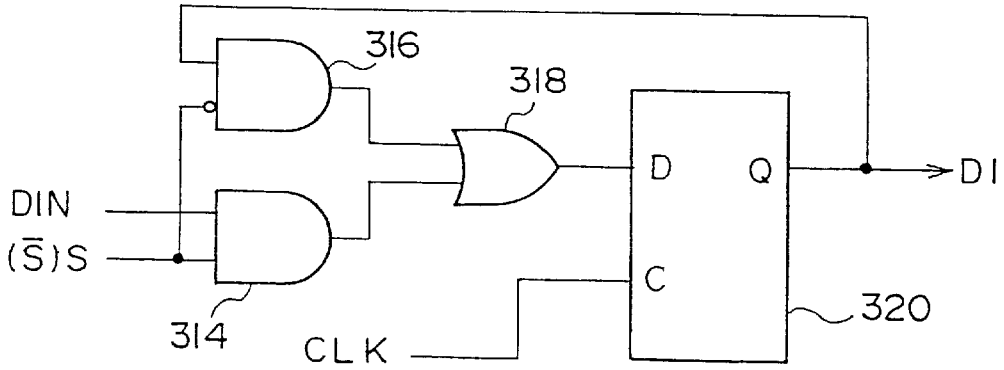
FIGS. 3A and 3B are circuit diagrams showing examples of first and second latch circuits shown in FIG. 2.
Figure 3B:
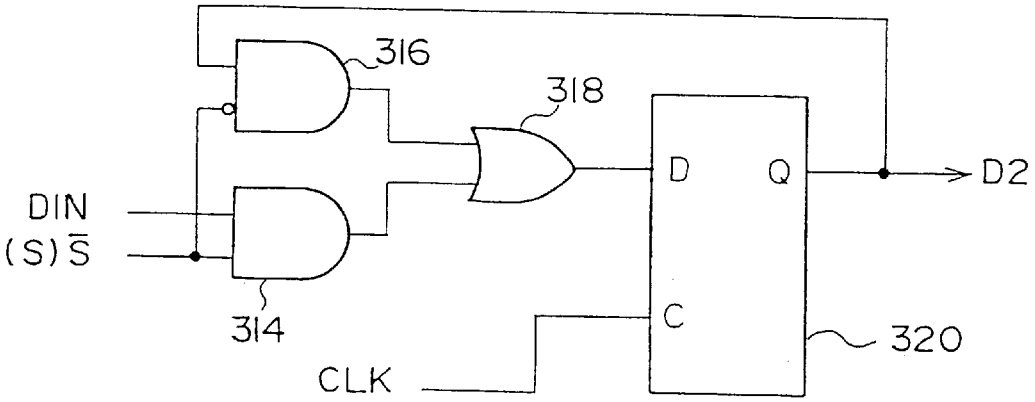

The first phase expansion circuit 310 has a first latch circuit 312*a* and a second latch circuit 312*b* to each of which the above-mentioned digital pixel data is input. As shown in FIGS. 3A and 3B, the first latch circuit 312*a* and the second latch circuit 312*b* have the same configuration and each have first and second AND circuits 314 and 316, an OR circuit 318 and a flip-flop 320.

To the first AND circuit 314 of the first or second latch circuit 312*a*, a frequency-divided clock S (having a frequency of, for example, 20 MHz) obtained by frequency-dividing a reference clock CLK (having a frequency of, for example, 40 MHz) or an inverted clock $\overline{S}$ which is the inverse of the clock S is input from the timing generation circuit block 200. The timing generation circuit block 200 controls, according to a horizontal scanning signal and/or a vertical scanning signal, change of the circuits to which frequency-divided clock S and inverted clock $\overline{S}$ are input in such a manner that, when frequency-divided clock S is input to the first latch circuit 312*a*, the corresponding inverted clock $\overline{S}$ is input to the second latch circuit 312*b*. In this sense, the timing generation block 200 functions as a change control means for controlling change of the phase expansion order in the first phase expansion circuit 310.

To the OR circuit 318, outputs from the first and second AND circuits 314 and 316 are input. An output from the OR circuit 318 is supplied to a D terminal of the flip-flop 320. To a clock terminal C of the flip-flop 320, reference clock CLK is input. These reference clock 200, frequency-divided clock C, inverted frequency-divided clock $\overline{S}$ are supplied from the timing generation circuit 200 to the flip-flop 320.

Figure 4:
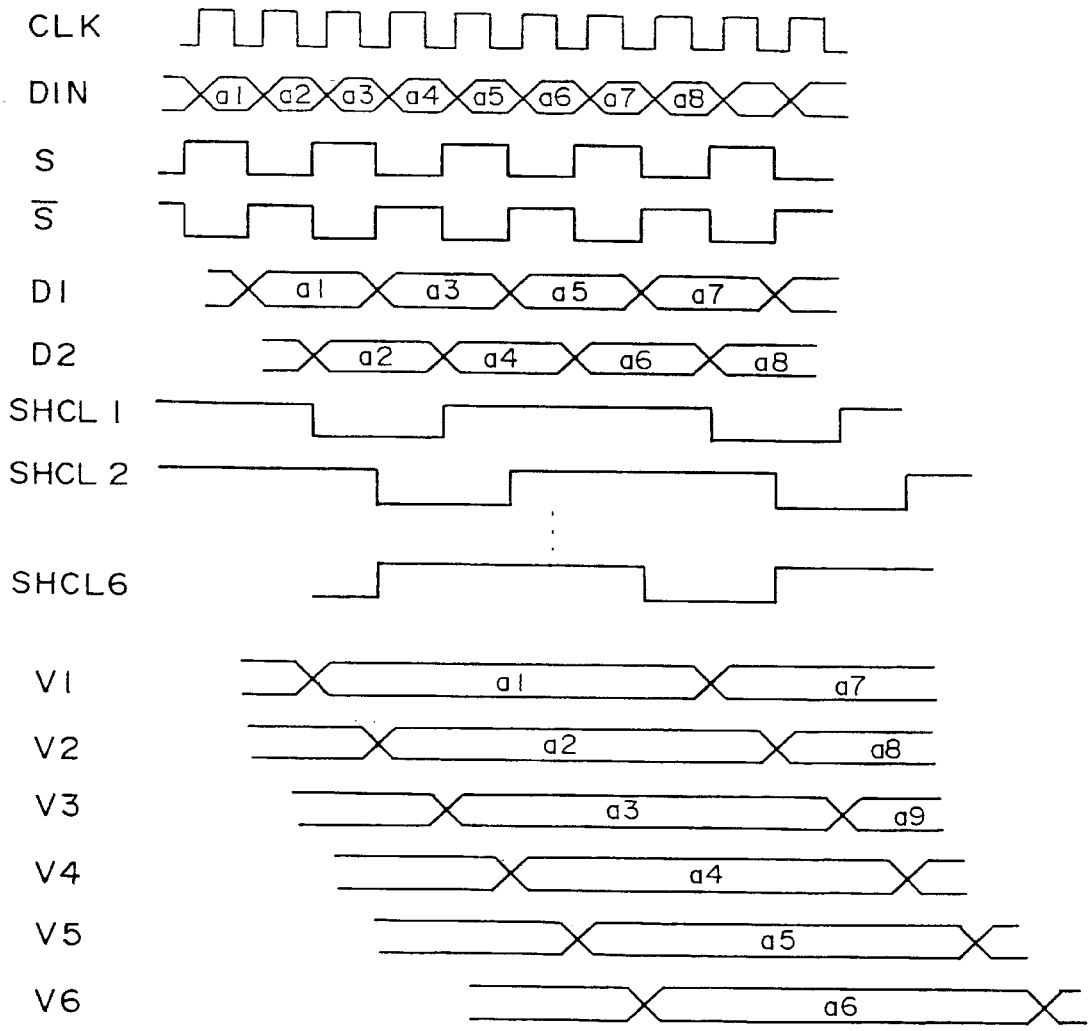
FIG. 4 is a timing chart for explanation of the data expansion operation of first and second phase expansion circuits shown in FIG. 2.

If, for example, frequency-divided clock S is input to the first latch circuit 312*a*, the first latch circuit 312*a* latches data al by a fall of frequency-divided clock S, as shown in FIG. 4. When frequency-divided clock S becomes LOW, the output of the second AND circuit 314 becomes HIGH simultaneously, thereby sustaining the latched data al as Q output. This operation is continued until data a3 is latched by the next fall of frequency-divided clock S. Thus, in the first latch circuit 312*a*, data a1, a3, a5 . . . are latched and phase-expanded so that the data length is twice the original length. An output signal from the first latch circuit 312*a* thus obtained will be referred to as digital phase-expanded signal D1. In the above-described case, in the second latch circuit 312*b* to which inverted frequency-divided clock $\overline{S}$ is input, data a2, a4, a6 . . . are also latched and phase-expanded so that the data length is twice the original length and are output by being delayed by the period of one cycle of reference clock CLK (half period of frequency-divided clock $\overline{S}$), as shown in FIG. 4. An output signal from the second latch circuit 312*b* thus obtained will be referred to as digital phase-expanded signal D2.

The branching circuit 330 has, as shown in FIG. 2, first and second branch lines 332*a* and 332*b* to which digital phase-expanded signal D1 is supplied, and third and fourth branch lines 332*c* and 332*d* to which digital phase-expanded signal D2 is supplied. A buffer 334 is connected to each of the first and third branch lines 332*b* and 332*d* to directly output digital phase-expanded signal D1 or D2. An inverter 336, for example, is connected to each of the second and fourth branch lines 332*b* and 332*d* to output digital phase-expanded signal D1 or D2 while inverting the polarity of the signal.

As a method of inverting the polarity of a digital signal, one of a method of inverting the logical state of digital values, and a method of obtaining the 2's complement of binary digital values, for example, may be used. In the former method, 2-bit data (11) is replaced with (00), for example. In the latter method, 2-bit data (11) is replaced with (01). In this manner, the polarity of voltages applied to pixels 116 can be inverted relative to the scanning signal. One of these two opposite polarities will be referred to as a first polarity, e.g., a positive polarity and the other is referred to as a second polarity, e.g., a negative polarity. To invert the polarity of the voltage applied to each pixel 116 in the case where, for example, the switching element 116*a* is formed of TFT, the potential of the data signal may be changed relative to the potential of the opposed (common) electrode. If the switching element 116*a* is formed of, for example MIM, the polarity may be changed by changing the potential of the scanning signal relative to a medium potential of the amplitude of data signals.

In this specification, signals obtained by polarity inversion from digital signals D1 and D2 are represented by $\overline{D1}$ and $\overline{D2}$. Also, analog signals respectively obtained by digital-to-analog conversion from digital signals D1, D2, $\overline{D1}$, and $\overline{D2}$ are represented by A1, A2, $\overline{A1}$ and $\overline{A2}$. These inverted signals $\overline{D1}$, $\overline{D2}$, and $\overline{A1}$ and $\overline{A2}$ correspond to those indicated with symbols D1, D2, A1, and A2 with upper bars in the diagram.

Digital phase-expanded signal D1 is output through the first branch line 332*a*, inverted signal $\overline{D1}$ of digital phase-expanded signal D1 through the second branch line 332*b*, digital phase-expanded signal D2 through the third branch line 332*c*, and inverted signal $\overline{D2}$ of digital phase-expanded signal D2 through the fourth branch line 332*d*.

The selection circuit 340 has a first digital switch 342 which connects to one of the first and second branch lines 332*a* and 332*b*, and a second digital switch 344 which connects to one of the third and fourth branch lines 332*c* and 332*d*.

The digital-to-analog conversion circuit 350 has a first digital-to-analog conversion circuit 352 for digital-to-analog conversion of digital phase-expanded signal D1 or $\overline{D1}$, which is input through the first digital switch 342, and a second digital-to-analog conversion circuit 354 for digital-to-analog conversion of digital phase-expanded signal D2 or $\overline{D2}$, which is input through the second digital switch 344. Each of the first and second digital-to-analog conversion circuits 352 and 354 performs, for digital-to-analog conversion, data sampling by sampling timing on the basis of frequency-divided clock S, so that a small size and a low price of the circuit can be maintained.

An output from the first digital-to-analog conversion circuit 352 will be referred to as a first phase-expanded analog signal A1 (or $\overline{A1}$), and an output from the second digital-to-analog conversion circuit 354 will be referred to as a first phase-expanded analog signal A2 (or $\overline{A2}$).

The gamma correction circuit 360 and the clamp circuit 370 are connected to output lines from the first and second digital-to-analog conversion circuits 352 and 354. In the gamma correction circuit 360, a first positive gamma correction circuit 362 and a first negative gamma correction circuit 364 are connected to the output line from the first digital-to-analog conversion circuit 352 while a second positive gamma correction circuit 366 and a second negative gamma correction circuit 368 are connected to the output line from the second digital-to-analog conversion circuit 354. In the clamp circuit 370, a first positive clamp circuit 372 and a first negative clamp circuit 374 are connected to the output line from the first digital-to-analog conversion circuit 352 while a second positive clamp circuit 376 and a second negative clamp circuit 378 are connected to the output line from the second digital-to-analog conversion circuit 354. These gamma correction circuits 362 to 368 and clamp circuits 372 to 378 are the same as well-known ones and, therefore, will not be explained.

The second phase expansion circuit 380 has six, first to sixth sample and hold circuits 381 to 386. First phase-expanded analog signal A1 (or $\overline{A1}$) is constantly supplied via the first digital-to-analog circuit 352 to the odd-numbered sample and hold circuits 381, 383, and 385 in the second phase expansion circuit 380. On the other hand, second phase-expanded analog signal A2 (or $\overline{A2}$) is constantly supplied via the second digital-to-analog circuit 354 to the even-numbered sample and hold circuits 382, 384, and 386 in the second phase expansion circuit 380. As shown in FIG. 4, sampling clocks SHCL1 to SHCL6 which determine phase expansion order are input to the first to sixth sample and hold circuits 381 to 386 to further N-phase-, e.g., 3-phase-expand the first phase-expanded analog signal. Since the signal has already been n-phase-, e.g., 2-phase-expanded, the signal is expanded in n X N=6 phases in comparison with the data length of the original pixel data.

Figure 5:
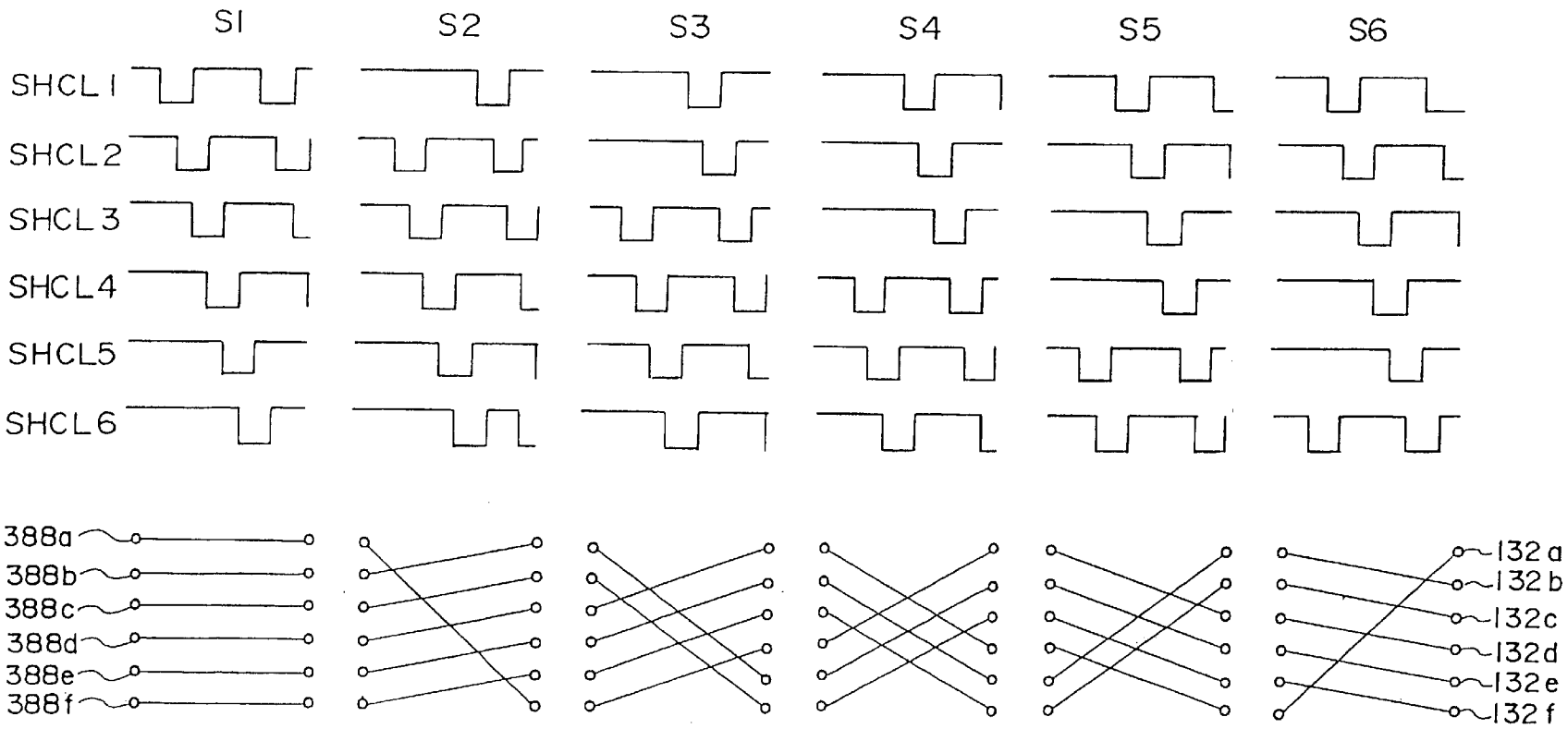
FIG. 5 is a schematic explanatory diagrams for explanation of kinds of sampling signals input to the second phase expansion signal shown in FIG. 2 and line connection states correspondingly changed by a connection change circuit.
Figure 6:
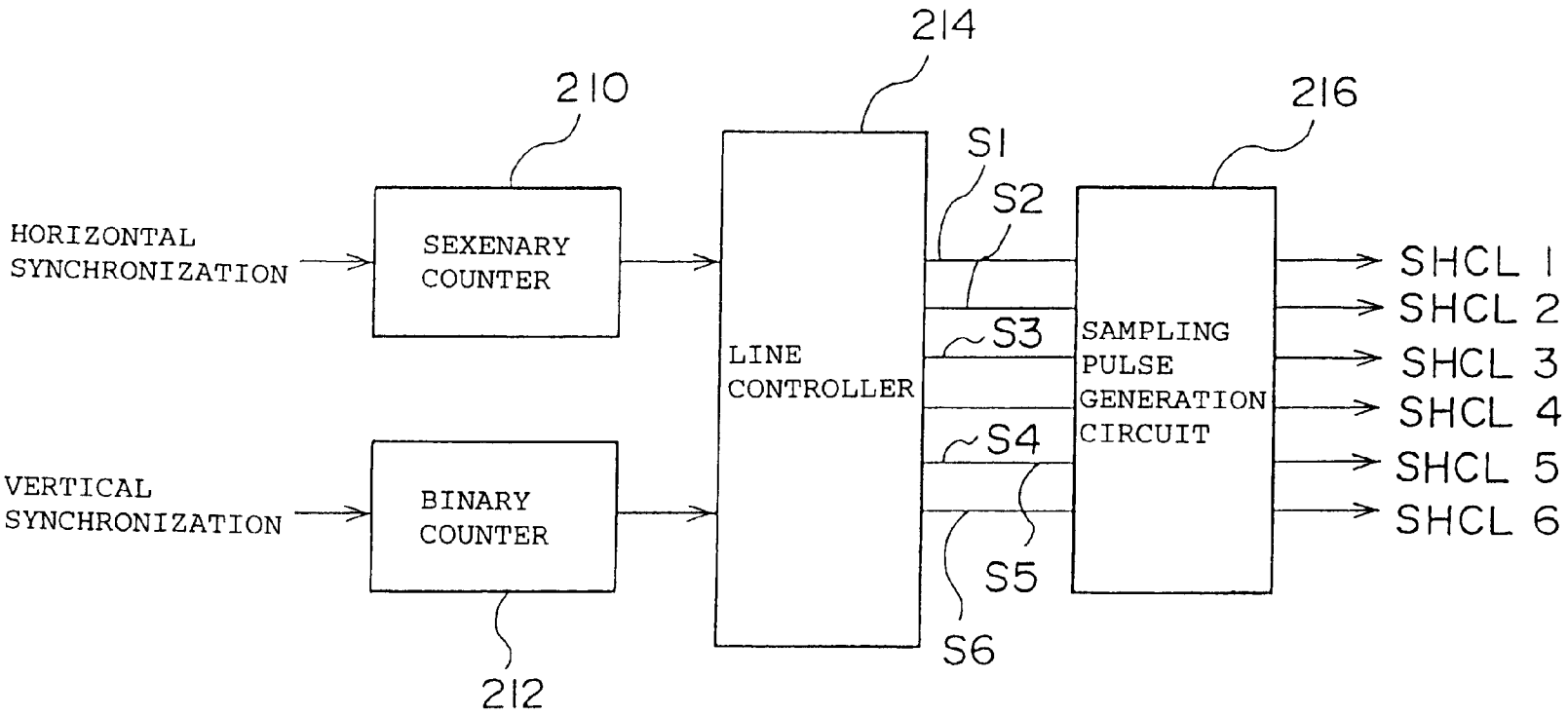
FIG. 6 is a block diagram showing a portion of a timing generation circuit block shown in FIG. 2.

Six clocks SHCL1 to SHCL6 are provided, as shown in FIG. 5. Clocks SHCL1 to SHCL6 are generated on the basis of select signals S1 to S6 in the timing generation circuit block 200. In this apparatus, six sampling clocks SHCL1 to SHCL6 supplied are changed in accordance with a horizontal sync signal and a vertical sync signal in driving the liquid crystal panel 110. In the timing generation circuit 200, therefore, a sexenary counter 210 and a binary counter 212 are provided, as shown in FIG. 6. The sexenary counter 210 counts pulses of the horizontal scanning signal. The binary counter 212 counts pulses of the vertical scanning signal. A line controller 214, which is supplied with outputs from these two counters 210 and 212, successively outputs select signals S1 to S6 by changing these signals one to another each time the sexenary counter 210 counts, in other words, when each horizontal scan (1H) is made by newly selecting one of the scanning signal lines 114 shown in FIG. 1. The line control 214 can also change the select signals S1 to S6 output order each time the binary counter 212 counts, in other words, when one-frame drive of the liquid crystal display shown in FIG. 1 is performed and when each vertical scan (1V) is started. For example, the line control 214, having output the select signals from S1 for the first frame, can start outputting the select signals from S2 for the second frame. Six sampling clocks SHCL1 to SHCL6 are generated in a sampling clock generation circuit 216, to which select signals S1 to S6 are input. A circuit for determining one of frequency-divided clock S and inverted clock $\overline{S}$ supplied to the first and second latch circuit 312*a* or 312*b* of the first phase expansion circuit 310 is provided in the timing generation circuit block 200, although it is not illustrated in the circuit diagram.

Outputs from the first to sixth sample and hold circuits 381 to 386, supplied to phase-expanded signal output lines 388*a* to 388*f* will be referred to briefly as V1 to V6. With respect to a rearrangement of these outputs V1 to V6 at pixel positions, four drive methods shown in FIGS. 7 to 10 are conceivable.

Referring to FIG. 7, the sampling order is changed in accordance with select signal S1 with respect to first line of each of frames 1 and 2, select signal S2 with respect to the second line, select signal S3 with respect to the third line, . . . and select signal S6 with respect to the sixth line. This is done recursively with respect to the subsequent lines. If the number of lines in one frame is a multiple of 6, repeating this cycle results in same sampling order with respect to the second frame. The sexenary counter 210 may be reset at the end of one frame irrespective of whether or not the number of lines in one frame is a multiple of 6, thereby setting the same expansion order with respect to the first and second frames.

Signs "+" and "−" in FIG. 7 designate polarities of data sampled and held. Dot inverting drive such as shown in FIG. 7 can be performed by operating the first and second digital switches 342 and 344 by the signals from the timing generation circuit 200. FIG. 11 shows the result of replacement of the contents of FIG. 7 with pixel data.

Referring to FIGS. 8 and 9, changes in sampling order are the same as those shown in FIG. 7 but the first and second digital switches 342 and 344 are changed in a different manner. The contents of FIG. 8 correspond to line inverting drive and the result of replacement of the contents of FIG. 8 with pixel data are as shown in FIG. 12. On the other hand, the contents of FIG. 9 correspond to frame inverting drive and the result of replacement of the contents of FIG. 9 with pixel data are as shown in FIG. 13.

FIG. 10 shows the method most favorable in terms of display characteristics. The frame 1 of FIG. 10 is the same as the frame 1 of FIG. 7 but frame 2 of FIG. 10 is different from frame 2 of FIG. 7. In the method shown in FIG. 10, the sampling order at the first line of frame 2 is made different from that in frame 1 such that the first line of frame 2 is the same as the second line of frame 1. That is, while the expansion order is successively changed starting from select signal S1 with respect to frame 1, the expansion order is successively changed starting from select signal S2 with respect to frame 2. This operation is shown as dot inverting drive in FIG. 11 by replacement with pixel data.

In the connection change circuit 390, the connection between six phase-expanded signal output lines 388*a* to 388*f* and six signal supply lines 132*a* to 132*f* is changed so that pixel data is supplied as shown in FIGS. 11 to 13. It is necessary to perform this changing in synchronization with the above-described change of the phase expansion order in the first and second phase expansion circuits 310 and 380. The connection is selected from six modes shown in FIG. 5. By this changing, each of the dot inverting drive, the line inverting drive and the frame inverting drive shown in FIGS. 11 to 13 can be realized. From the viewpoint of the life of the liquid crystal, the dot inverting drive shown in FIG. 11 is considered to be the best.

Each drive, however, is advantageous in that, even if the gains of the amplifiers of the first to sixth sample and hold circuits 381 to 386 vary, for example, the gain of one of the amplifiers is higher, brighter pixels can be obliquely dispersed to become visually unnoticeable by being prevented from being arrayed continuously in the vertical direction on the liquid crystal panel 110 as in the case of the conventional art. In particular, if the changing method shown in FIG. 10 is used, a further improvement in image quality can be achieved because the sampling order is also changed with respect to frames to change the positions of brighter pixels.

To obtain various control signals for realizing the phase expansion order in the first and second phase expansion circuits 310 and 380 for each of the methods shown in FIGS. 7 to 11, the combination of connection changes in the changing circuit 390 required simultaneously, and the switching operation of the first and second digital switches 342 and 344 also required simultaneously, the corresponding modes may be stored in a memory, for example, and a user may select each mode by supplying a signal to an external terminal of an IC. Alternatively, selection of each mode may be enabled as an internal change in an IC in a factory producing the IC.

Second Embodiment

Figure 14:
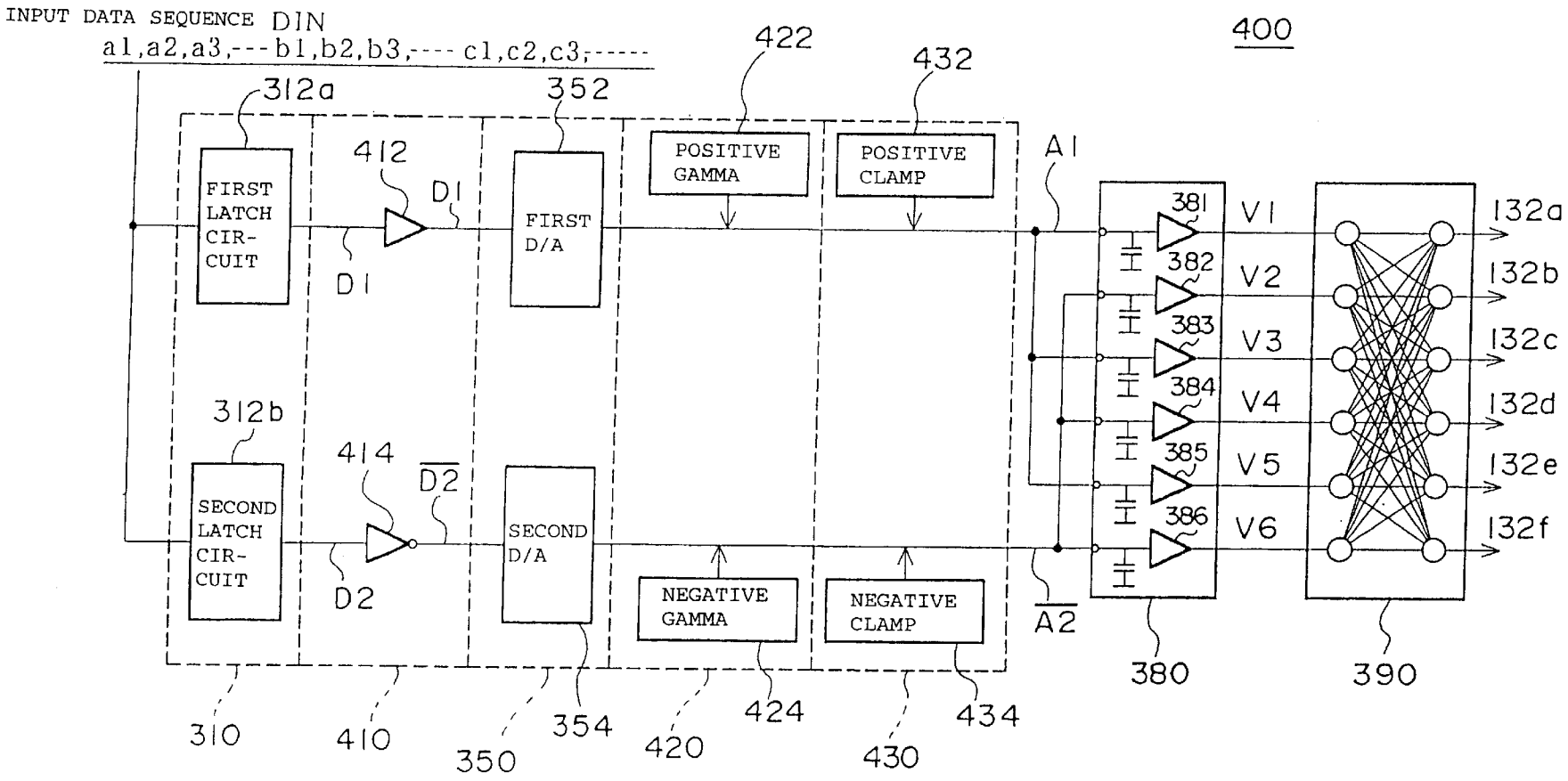
FIG. 14 is a block diagram showing another example of the data processing block of the image display apparatus shown in FIG. 1.

FIG. 14 shows a more preferable data processing circuit block 400, which can be used in place of the data processing circuit 300 shown in FIG. 1. The data processing circuit block 400 shown in FIG. 14 differs from the data processing circuit 300 in that it has a polarity determination circuit 410 in place of the branching circuit 330 and the selection circuit 340 shown in FIG. 2, and that a gamma correction circuit 420 and a clamp circuit 430 are provided in place of the gamma correction circuit 360 and the clamp circuit 370 shown in FIG. 2.

The polarity determination circuit 410 has a buffer 412 which directly outputs digital phase-expanded signal D1 from the first latch circuit 312a, and an inverter 414 which inverts digital phase-expanded signal D2 from the second latch circuit 312*b* and outputs the inverted signal. Therefore, digital phase-expanded signal D1 and the digital phase-expanded signal $\overline{D2}$ are constantly output from the buffer 412 and the inverter 414, respectively.

The gamma correction circuit 420 has a positive gamma correction circuit 422 for executing positive gamma correction of the output from the buffer 412, and a negative gamma correction circuit 424 for executing negative gamma correction of the output from the inverter 414. Similarly, the clamp circuit 430 has a positive clamp circuit 432 for clamping an output from the positive gamma correction circuit 422 with positive polarity, and a negative clamp circuit 434 for clamping an output from the negative gamma correction circuit 424 with negative polarity.

Thus, the data processing circuit 400 shown in FIG. 14 has a smaller number of circuits in comparison with the data processing circuit 300 shown in FIG. 2.

In this second embodiment, data outputs shown in FIG. 10 can be obtained as outputs from the second phase expansion circuit 380 in a simple manner while the number of circuits is reduced, and dot inverting drive shown in FIG. 11, which is favorable in terms of liquid crystal life characteristics, can be performed.

Third Embodiment

Figure 15:
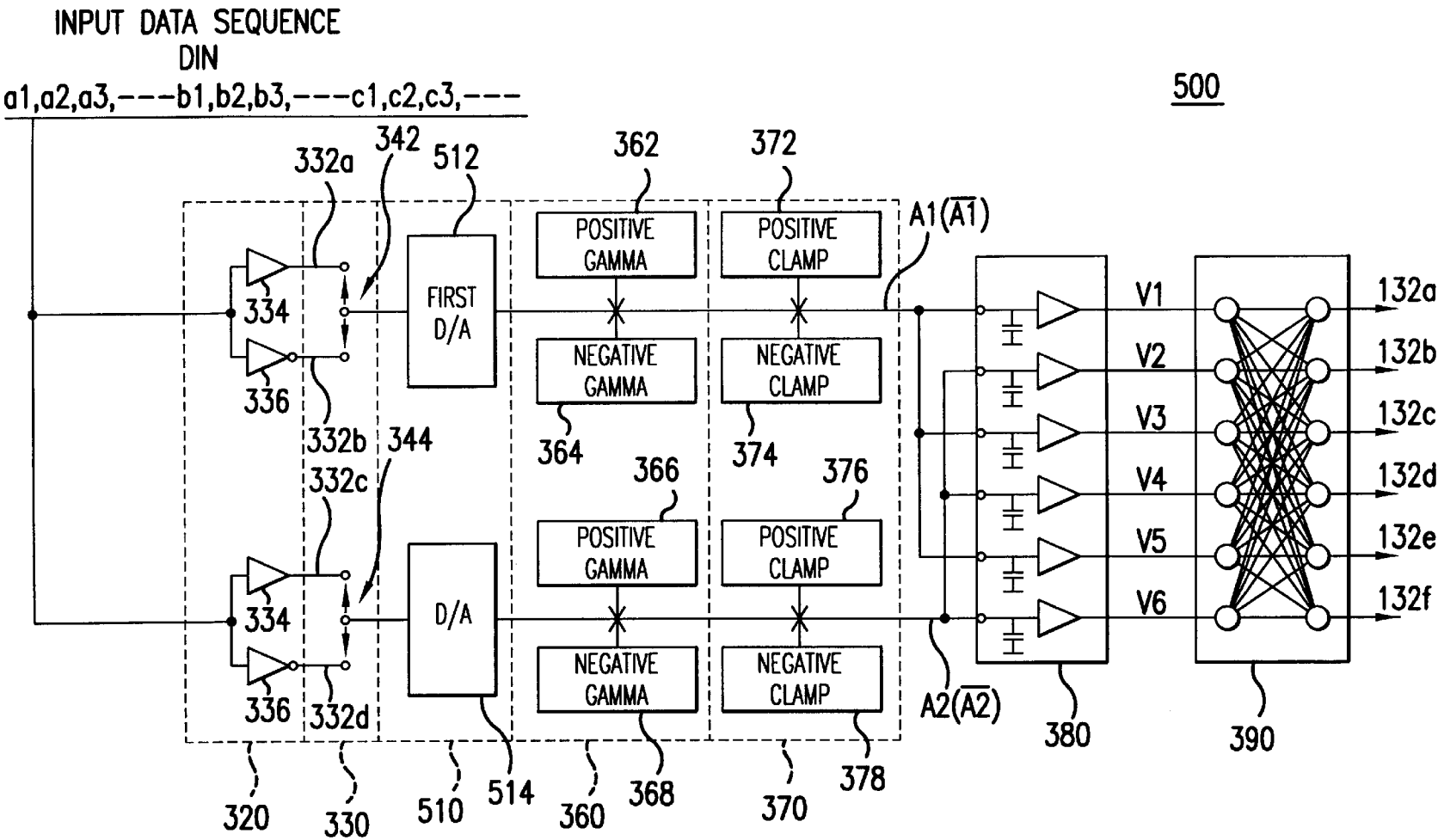
FIG. 15 is a block diagram showing still another example of the data processing block of the image display apparatus shown in FIG. 1.

FIG. 15 shows another data processing circuit block 500, which can be used in place of the data processing circuit 300 shown in FIG. 1. The data processing circuit block 500 shown in FIG. 15 is formed in such a manner that the first phase expansion circuit 310 shown in FIG. 2 is removed and a digital-analog circuit 510 is provided in place of the digital-to-analog conversion circuit 350 shown in FIG. 2.

This digital-analog circuit 510 has a first digital-to-analog conversion circuit 512 which performs digital-to-analog conversion of pixel data of positive or negative digital signal DIN or $\overline{DIN}$ selected by the first digital switch 342 to output a first analog signal A1 or $\overline{A1}$, and a first digital-to-analog conversion circuit 514 which performs digital-to-analog conversion of positive or negative digital signal DIN or $\overline{DIN}$ selected by the second digital switch 344 to output a second analog signal A2 or $\overline{A2}$.

These first and second digital-to-analog circuits 512 and 514 may have a function of sampling and holding odd or even pixel data of a digital signal, as does the circuit shown in FIG. 3, to output first phase-expanded analog signals A1 ($\overline{A1}$) and A2 ($\overline{A2}$) having a data length twice as long as the original data length, as are those shown in FIG. 2. Thus, the first and second digital-to-analog conversion circuit 512 and 514 may also have the function of the first phase expansion circuit 310. In such a case, the subsequent data processing is the same as that in the case shown in FIG. 2, and 3-phase expansion may be performed by the second phase expansion circuit 380. If the first and second digital-analog circuits 512 and 514 have no sample and hold function, 6-phase expansion may be performed by only one phase expansion circuit, i.e., the second phase expansion circuit 380.

In this third embodiment, therefore, each of the four patterns of data outputs shown in FIGS. 7 to 10 can be obtained as outputs from the second phase expansion circuit 380, thus enabling the various inverting drives shown in FIGS. 11 to 13.

Fourth Embodiment

Figure 16:
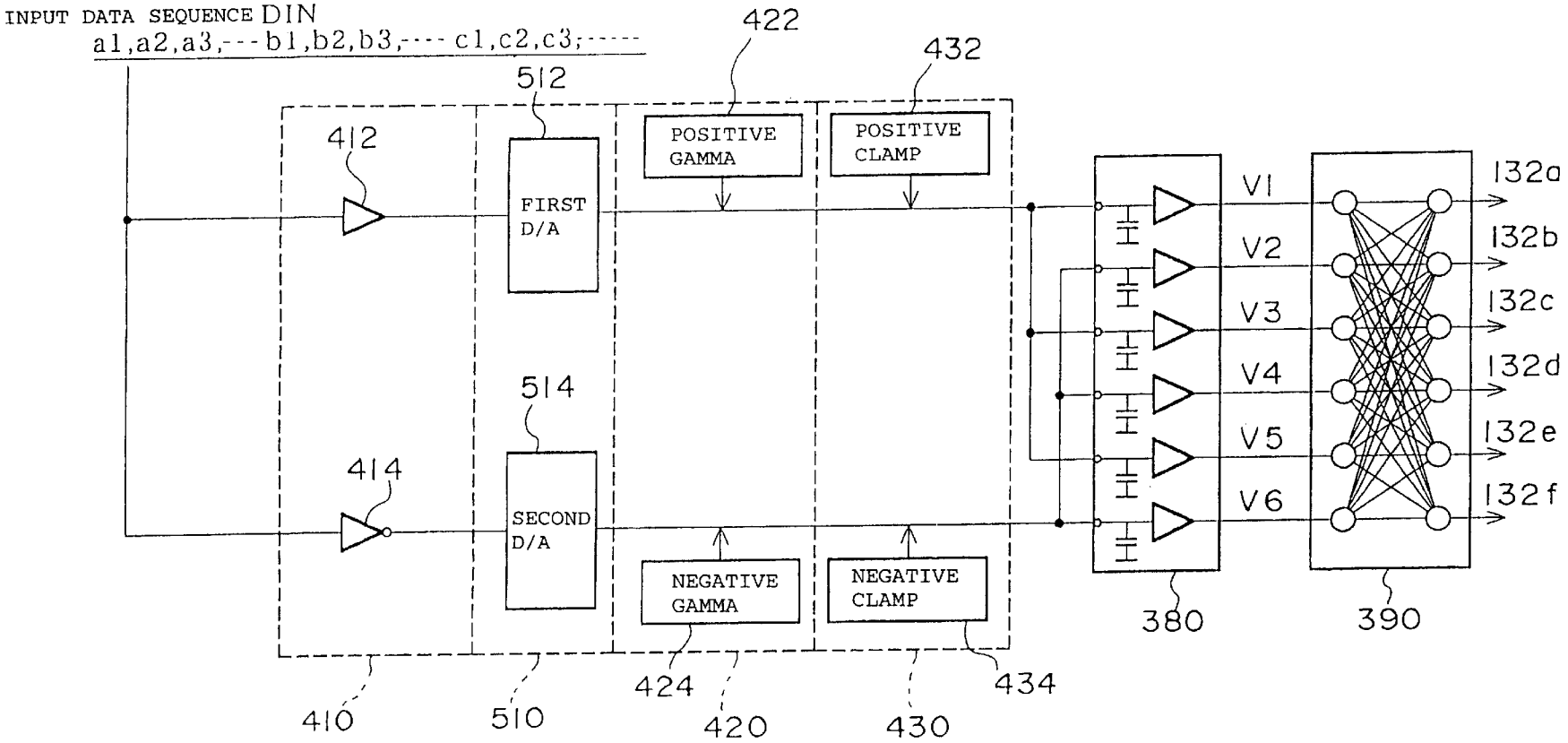
FIG. 16 is a block diagram showing a further example of the data processing block of the image display apparatus shown in FIG. 1.

FIG. 16 shows still another data processing circuit block 600, which can be used in place of the data processing circuit 300 shown in FIG. 1. The data processing circuit block 600 shown in FIG. 16 differs from the data processing circuit 500 shown in FIG. 15 in that it has the polarity determination circuit 410 described above with reference to FIG. 14 in place of the branching circuit 330 and the selection circuit 340 shown in FIG. 15, and that the gamma correction circuit 420 and the clamp circuit 430 described above with reference to FIG. 14 are provided in place of the gamma correction circuit 360 and the clamp circuit 370 shown in FIG. 15.

Thus, the difference of the operation of the circuits shown in FIG. 16 from that of the circuits shown in FIG. 15 is the same as the difference between the operations of the circuits shown in FIGS. 2 and 14. Consequently, in this fourth embodiment, each of the two patterns of data outputs shown in FIGS. 7 and 10 can be obtained in a simple manner while the number of circuits is reduced, thus enabling the dot inverting drive shown in FIG. 11, which is favorable in terms of liquid crystal life characteristics.

Fifth Embodiment

Figure 17:
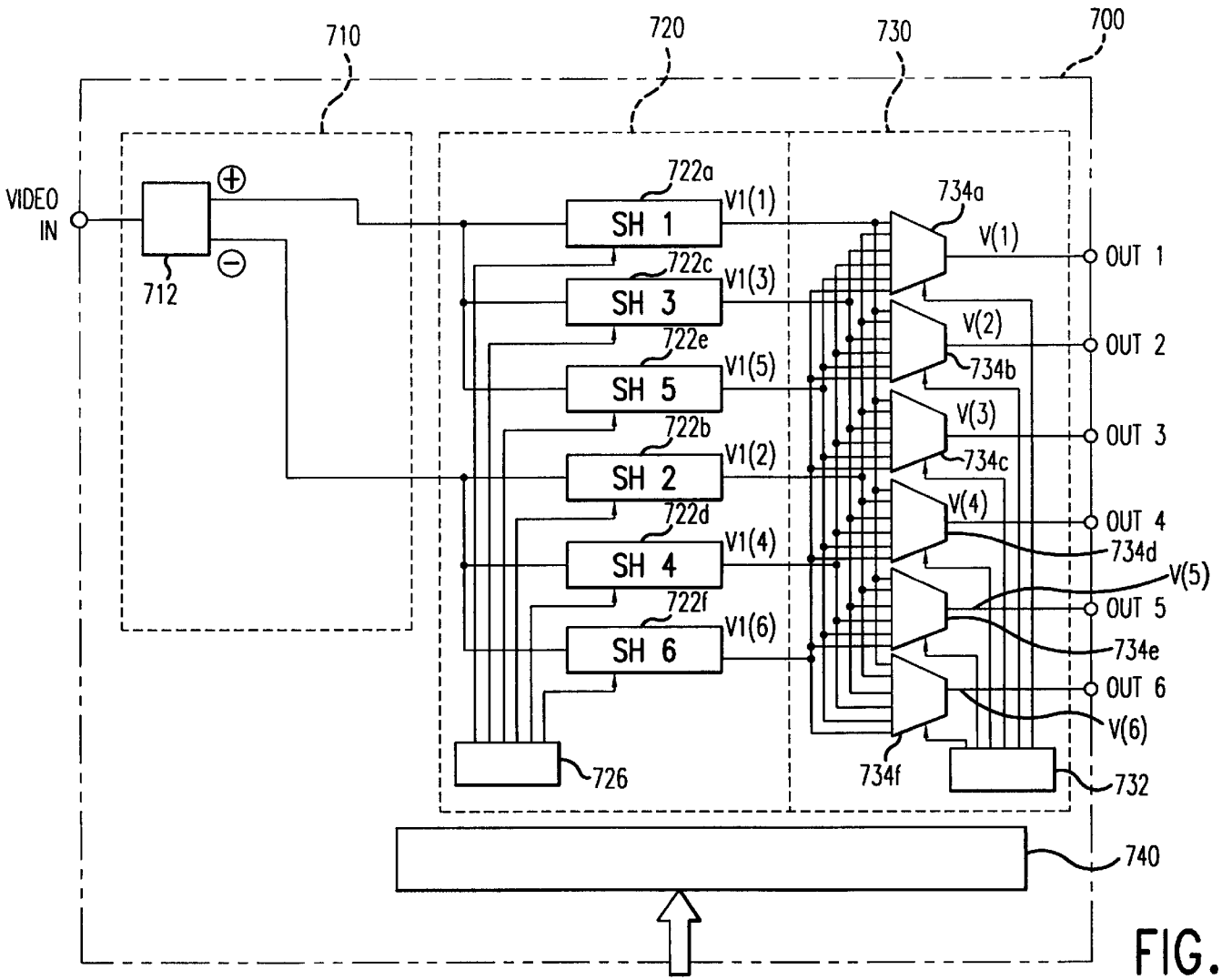
FIG. 17 is a block diagram showing a still a further example of the data processing block of the image display apparatus shown in FIG. 1.

FIG. 17 shows a further data processing circuit block 700, which can be used in place of the data processing circuit 300 shown in FIG. 1. The data processing circuit block 700 shown in FIG. 17 is supplied with an analog video signal VIDEO unlike from those of the above-described embodiments. This data processing circuit block 700 has a polarity inversion circuit 710, a phase expansion circuit 720, a rotation circuit 730, and a control circuit 740 for controlling these circuits.

As shown in FIG. 17, the polarity inversion circuit 710 has a signal output circuit 712 which forms two signals: a video signal of a normal polarity (positive signal) and a video signal of an inverse polarity (negative signal) from input video signal VIDEO, and which outputs the two signals formed. These two signals are inverse in polarity relative to each other so that, for example, a medium potential between their black levels is a common potential.

The video signal of the positive polarity VIDEO (+) in the signals output from the signal output circuit 712 is constantly supplied to odd-numbered sample and hold circuits 722*a*, 722*c*, and 722*e* of the phase expansion circuit 720 described below while the video signal of the negative polarity VIDEO (−) in the signals output from the signal output circuit 712 is constantly supplied to even-numbered sample and hold circuits 722*b*, 722*d*, and 722*f* of the phase expansion circuit 720 described below. When input video signal VIDEO is phase-expanded, sampling start times are set alternately for the odd-numbered sample and hold circuits and the even-numbered sample and hold circuits as expansion order. The odd phases and even phases are thereby made always opposite in polarity from each other. In this manner, occurrence of crosstalk in the horizontal direction can be prevented.

In the phase expansion circuit 720, the order in which input video signal VIDEO is phase-expanded by the sample and hold circuits 722*a* to 722*f* (phase expansion order) is shifted by the timing of the horizontal sync signal. Also, in the rotation circuit 730, the combination of connections between the output lines from the sample and hold circuits 722*a* to 722*f* and output terminals OUT1 to OUT6 with respect to the six signal supply lines 132*a* to 132*f* is shifted by the timing of the horizontal sync signal. As a result, the potentials applied to the pixels of the liquid crystal panel 110 are also inverted in polarity between each adjacent pair of pixels arranged in the vertical direction, thereby preventing occurrence of crosstalk in the vertical direction as well as in the horizontal direction.

The phase expansion circuit 720 is arranged to expand input video signal VIDEO in six phases by using six sample and hold circuits 722*a* to 722*f*. The six sample and hold circuits 722*a* to 722*f* sample pixel signals in input video signal VIDEO in accordance with sample signals supplied from an expansion order designation circuit 726 to the sample and hold circuits 722*a* to 722*f*; each of the sample and hold circuits 722*a* to 722*f* samples the pixel signal of input video signal VIDEO supplied to it when it is supplied with one of the sample signals, and holds the sampled signal until it is supplied with the next sample signal. Thus, the pixel signals contained in input video signal VIDEO is expanded in six phases, as described above with reference to FIG. 6(*b*), thereby extending the data length per pixel. Thus, the frequency of panel drive video signals V(i) (i=1 to 6) supplied from output terminals OUT1 to OUT6 to the signal supply lines 132*a* to 132*f* after being passed through the rotation circuit 730 can be reduced. With respect to the data-side drive circuit 130, there is a need to sufficiently increase the time period through which the liquid crystal layer 116*b* is charged and, hence, a need to reduce the operating speed of the data-side drive circuit 130. It is, therefore, possible to effect matching between the operating speed of the data-side drive circuit 130 and the frequency of input video signal VIDEO in the liquid crystal panel 110 in which the data-side drive circuit 130 is formed along with TFTs 116*a* on the glass substrate. As a result, even if the liquid crystal panel 110, in which the operating speed of the data-side drive circuit 130 is not so high, is used as a display unit, a high-quality image can be displayed at a high resolution. The phase expansion circuit 720 described above can be formed of sample and hold circuits which sample and hold pixels signals in the analog form with respect phases, as in this embodiment. If pixel signals formed as digital signals are input, latch circuits, such as those shown in FIG. 3, which latch data with respect to phases, may be used. In the first and second embodiments, phase expansion is executed at two stages, that is, digital signal phase expansion and analog signal phase expansion are performed. However, one-stage analog signal phase expansion, performed in this embodiment, or one-stage digital signal phase expansion may alternatively be performed.

However, if the combination of panel drive video signal V(i) and the circuits of the channels in the phase expansion circuit 720 is completely fixed, a difference in a circuit characteristic such as gain may occur due to a non-uniformity of the environment around the phase expansion circuit 720 or the elements constituting the circuits to cause vertical line unevenness.

In the image display apparatus of this embodiment, therefore, the rotation circuit 730 is provided as connection changing means to prevent occurrence of such vertical line unevenness. That is, the rotation circuit 730 has a rotation control circuit 732, and six 6-input one-output analog switches 734*a* to 734*f*. To the rotation control circuit 732, timing signals are input from the timing generation circuit block 200. In accordance with the timing signals, the rotation control circuit 732 outputs, to each of the analog switches 734*a* to 734*f*, a select signal which designates one of the sample and hold circuits 722*a* to 722*f* of the phase expansion circuit 720 holding one of video signals V1(i) to be selected and output. Each of the analog switches 734*a* to 734*f* selects one of video signals V1(i) held by the sample and hold circuits 722*a* to 722*f* in accordance with the select signal applied to it. The rotation control circuit 732 for generating such select signals can be realized by using counters 210 and 212 provided in the timing generation circuit 200 described above with respect to the example shown in FIG. 6, or the like.

The rotation control circuit 732 holds several unit combinations of video signals V1(i) and panel drive video signals V(i), i.e., combinations of the sample and hold circuits 722*a* to 722*f* and the output terminals OUT1 to OUT6, and changes these combinations by predetermined timing.

In this embodiment, the rotation control circuit 732 has six sets of selection signals S1 to S6 and changes these signals in synchronization with the video display horizontal sync signal. In this case, the relationship between select signals S1 to S6 at the analog switches 734*a* to 734*f* and the inputs and outputs (combinations of panel drive signals V(i) and video signals V1(i)) is as shown in FIG. 18. FIG. 18 shows the state where video signals V1(i) held by the sample and hold circuits 722*a* to 722*f* to be output as panel drive signals V(i) are changed in synchronization with the horizontal sync signal by select signals S1 to S6.

However, in order to change the combination of video signals V1(i) held by the sample and hold circuits 722*a* to 722*f* and panel drive video signals V(i) by select signals S1 to S6 in the rotation circuit 730, it is necessary to previously change the order in which the sample and hold circuits 722*a* to 722*f* hold input video signal VIDEO so that a predetermined one of the data signal lines 112 is supplied with a pixel signal correctly assigned to it. Such expansion order control is performed by the expansion order designation circuit 726 based on the timing of changing select signals S1 to S6. That is, a control circuit 702 controls the expansion order designation circuit 726 and the rotation control circuit 732 in cooperation with the timing signals.

In the thus-arranged image display apparatus, reference clock signal CLK and synchronization signal SYNC are input to the timing generation circuit block 200, and the timing signals including the clock for operating each circuit block are output from the timing generation circuit block 200.

In the data processing circuit block 700, 6-phase expansion of input video signal VIDEO is performed by the phase expansion circuit 720, and phase-expanded video signals V1(i) are held by the sample and hold circuits 722*a* to 722*f*.

Phase-expanded video signals V1(i) undergo rotation processing in the rotation circuit 730 to become panel drive video signals V(i). These panel drive video signals V(i) are output to the signal supply lines 132*a* to 132*f* via the output terminals OUT1 to OUT6 and the input terminals VIN1 to VIN6. The data-side drive circuit 130 samples, in the sampling switches 134, panel drive video signals V(i) in the respective phases appearing in the signal supply lines 132*a* to 132*f* by the sampling signals formed by the shift register 136 on the basis of the signals from the timing generation circuit block 200, and outputs predetermined potentials to the data signal lines 114.

Figure 19:
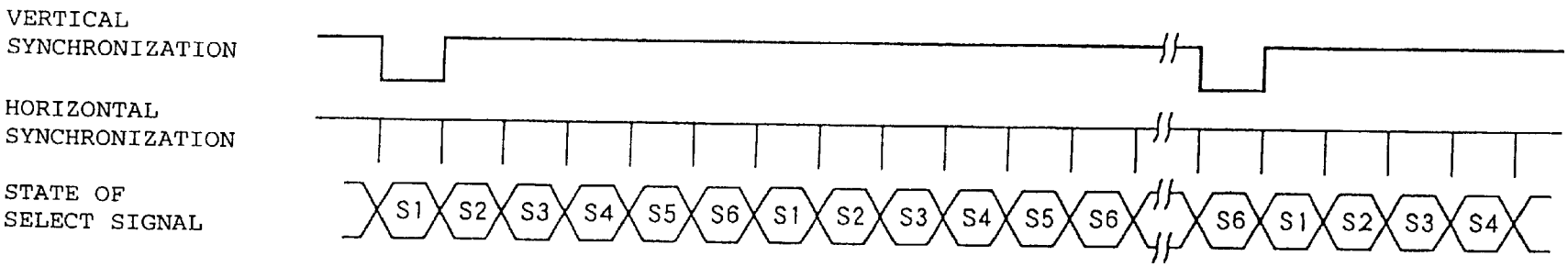
FIG. 19 is a diagram showing the state where select signals of the image display apparatus are changed in synchronization with a horizontal synchronization signal and a vertical synchronization signal.

During this operation, select signals S1 to S6 output from the rotation control circuit 732 change as shown in FIG. 19. For example, select signals S1 to S6 change in the order of S1, S2, S3, S4, S5, S6 . . . with respect to one frame in synchronization with the horizontal sync signal of the video signal, and change recursively in this order.

Such order may also be changed in synchronization with the vertical sync signal of the video signal. That is, for the next picture, select signals S1 to S6 change in the order of S6, S1, S2, S3, S4, S5, . . . with respect to one frame in synchronization with the horizontal sync signal of the video signal, and change recursively in this order.

As shown in FIG. 20, in the liquid crystal panel 102, at the first line, panel drive video signals V(i) are output in the order of video signals V1(1), V1(2), V1(3), V1(4), V1(5), V1(6) for display on the six pixels arranged in the horizontal direction. Then, at the second line, panel drive video signals V(i) are output in the order of video signals V1(6), V1(1), V1(2), V1(3), V1(4), V1(5) for display on the respective pixels.

With respect to the next picture, at the first line, panel drive video signals V(i) are output in the order of video signals V1(6), V1(1), V1(2), V1(3), V1(4), V1(5) for display on the six pixels arranged in the horizontal direction. Then, at the second line, panel drive video signals V(i) are output in the order of video signals V1(5), V1(6), V1(1), V1(2), V1(3), V1(4) for display on the respective pixels.

It is assumed here that one of the six sample and hold circuits 722*a* to 722*f*, for example, the sample and hold circuit 722*a*, has a gain lower than the gains of the others. In such a case, even if even-level input video signal VIDEO for a picture is input to make a display uniform in brightness through the entire picture, the strength of video signal V1(1) held by the sample and hole circuit 722*a* having a smaller gain is low, so that the pixels to which this signal is supplied as panel drive video signal V(i) are lower in display brightness than the others. In this embodiment, however, the combination of video signal V1(i) and panel drive video signal V(i) is shifted in synchronization with the horizontal sync signal by the rotation circuit 730. As a result, the pixels differing in brightness on the liquid crystal panel 110 are obliquely dispersed without being aligned on a vertical line, as shown in FIG. 20. Thus, an intrinsic difference between the sample and hold circuits 722*a* to 722*f* is displayed by being dispersed in one picture on the liquid crystal panel 110, and no vertical line non-uniformity appears on the liquid crystal panel 110.

Even if an oblique line display non-uniformity occurs, the position of the non-uniformity is changed each time the picture is changed, as shown in FIG. 20, because the select signals are changed in synchronization with the vertical sync signal. Therefore, the influence of a characteristic difference between sample and hold circuits or the like appearing when phase expansion is performed by the circuits can also be dispersed with respect to time, thus making it possible to obtain high-quality high-resolution images.

Figure 22A:
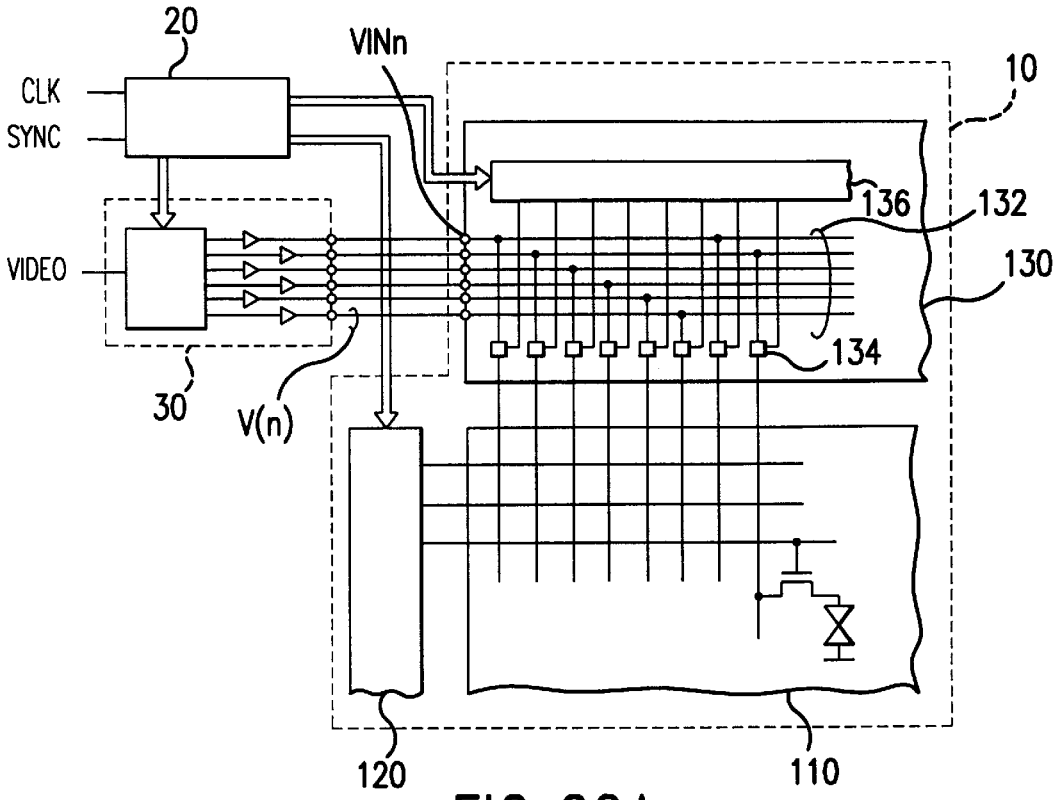
FIG. 22A PRIOR ART
FIG. 22A is a block diagram showing the configuration of a conventional image display apparatus which performs phase expansion.
Figure 22B:
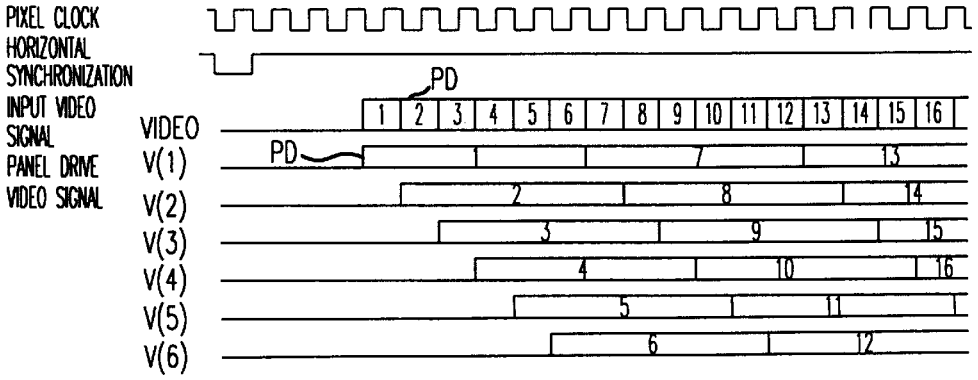
FIG. 22B PRIOR ART
FIG. 22B is a timing chart of the operation of this apparatus.
Figure 23:
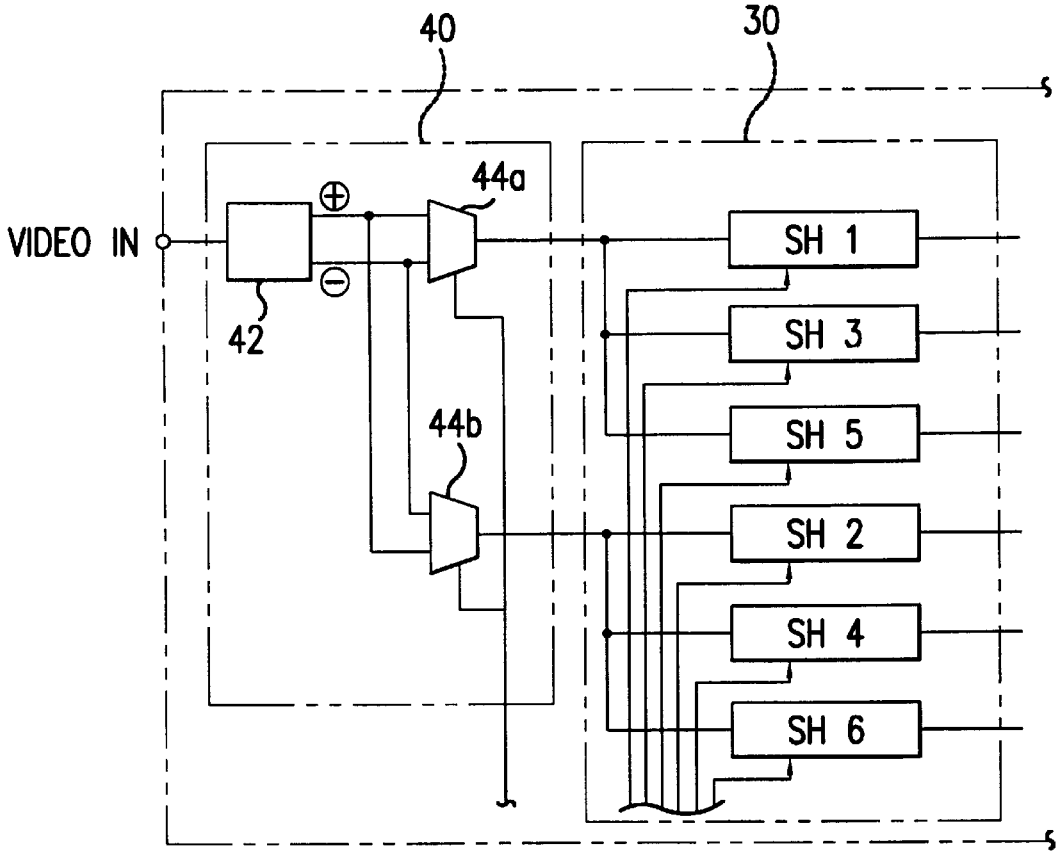
FIG. 23 PRIOR ART
FIG. 23 is a block diagram showing an example of an arrangement using selectors to perform one-dot polarity inverting drive in the image display apparatus shown in FIG. 22A.

Further, the select signals are changed to invert the polarities of panel drive video signals so that the polarities between each of adjacent pairs of pixels in the horizontal and vertical directions are always opposite from each other, thereby preventing crosstalk between each adjacent pair of pixels. According to the present invention, such one-dot polarity inverting display is achieved by the method essentially based on the combination of video signal V1(i) and panel drive video signal V(i). That is, it is not necessary for the polarity inversion circuit 710 to use selectors 42*a* and 42*b* formed of analog switches as shown in FIG. 22. The apparatus is therefore free from the need for handling video signals VIDEO (+) and (−) having a high frequency with analog switches, and can be simplified in circuit configuration. In the case where digital signals undergo phase expansion, the polarity of the signals is fixed with respect to each of the signal phases and, therefore, analog gamma correction and clamp processing for the signal of each polarity may suffice, so that the circuit configuration can be simplified.

In this embodiment, while the phase expansion circuit 720 is arranged so as to be able to expand input video signal VIDEO in six phases by using six sample and hold circuits 722*a* to 722*f*, it is, of course, possible to set a number of phases different from 6. Preferably, the number of phases is matched with the number of signal lines. Six-phase expansion, however, is advantageous in that, in the full-color liquid crystal panel 110, the same signal supply line 132 can be connected to the data signal lines 112 to pixels of the same color arranged in the horizontal direction.

After phase expansion, there is also a possibility of occurrence of a difference between offsets between the inputs and outputs of the analog switches in the rotation circuit 730. Ordinarily, such a difference is sufficiently small in comparison with those of the image signal holding circuits and amplifier circuits in the phase expansion circuit 720. Therefore, if the rotation circuit 730 is provided, a voltage difference between panel drive video signals V(i), i.e., a difference between the degrees of brightness on the pixels of the liquid crystal panel 110, can be reduced and the image quality improvement effect of the rotation processing is sufficiently high.

The relationship between select signals S1 to S6 or S1 to S3 at the analog switches and the combinations of phase-expanded video signals V1(i) and panel drive signals V(i) is not limited to that shown in FIG. 18. Any other conditions are possible as long as one-dot inverting display can be performed on the display unit by using the phase-expanded video signals.

The rotation circuit 730 or the data processing circuit block 700 including the rotation circuit 730 may be formed on a glass substrate outside the liquid crystal panel block 100 and may be formed in an IC. The rotation circuit 730 can be used in such an IC to eliminate the need for level adjustment between the channels of the signal processing circuits for phase expansion. Also, high-quality images can be obtained without any considerable problem even if there is a slight difference in level between the sample and hold circuits when these circuits are integrated in the IC. Thus, the above-described circuits can easily be integrated in an IC.

Sixth Embodiment

The first to fifth embodiments have been described with respect to an image display apparatus using liquid crystal panel 110 as an image display unit. Needless to say, an apparatus using electroluminescent elements, a CRT or the like as a display unit is also possible.

Further, a projection type image display apparatus using liquid crystal panel 110 as a light valve may also be formed, as described below.

Figure 21:
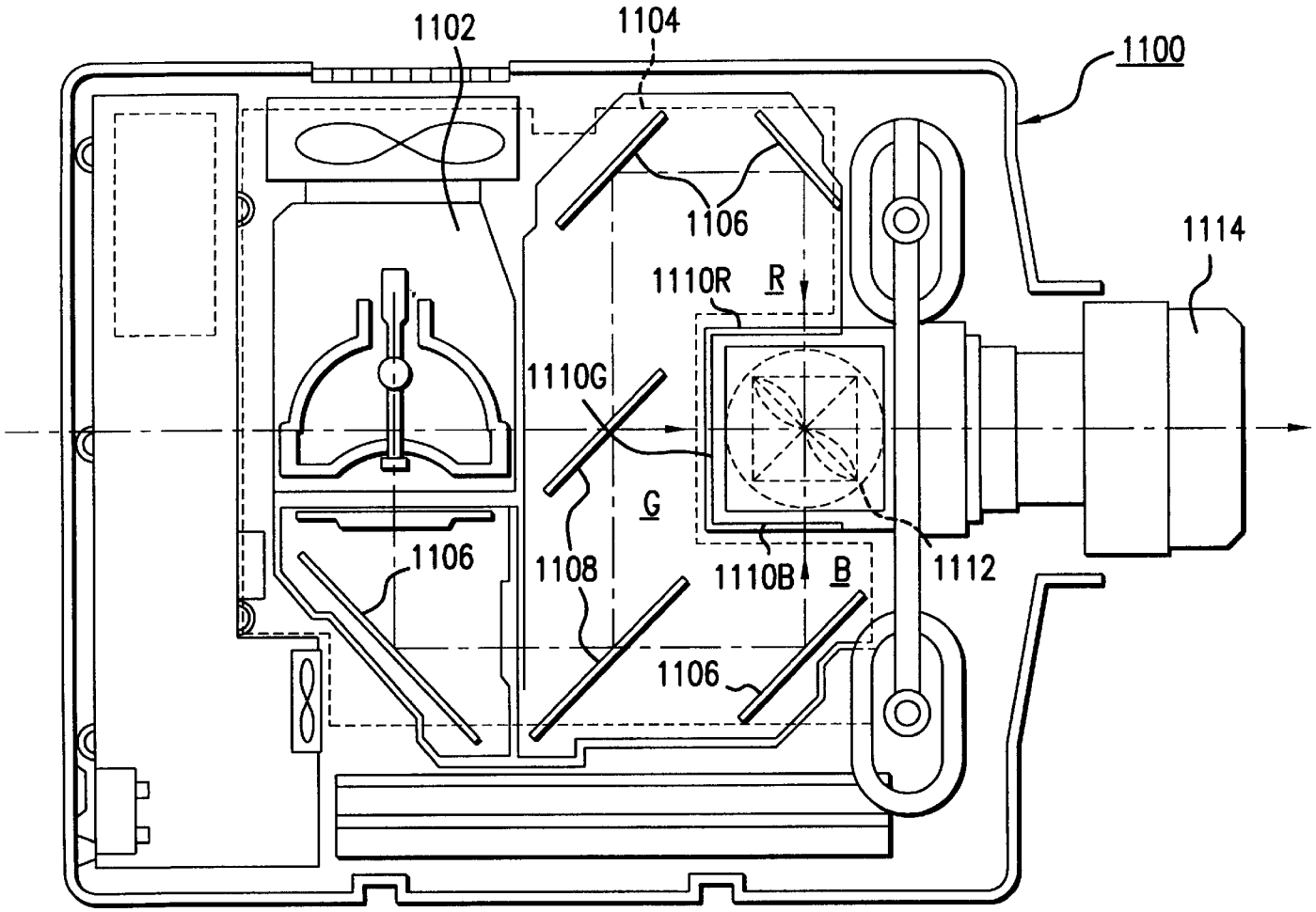
FIG. 21 is a diagram outlining a projection type image display apparatus (projector) to which the present invention is applied.

FIG. 21 schematically shows a projection type image display apparatus (projector) using a three-plate prism type optical system.

In the projector 1100 shown in FIG. 21, light projected from a white light source lamp unit 1102 is separated into three primary colors R, G, and B in a light guide 1104 by a plurality of mirrors 1106 and two dichroic mirrors 1108. Primary color light is led to three TFT liquid crystal panels 1110R, 1110G, and 1110B for displaying images in the corresponding colors. Light modulated with the TFT liquid crystal panels 1110R, 1110G, and 1110B is incident upon a dichroic prism 1112 in three directions. In the dichroic prism 1112, R light and B light are bent through 90° while G light travels straight. Images in the different colors are thereby combined into a multicolor image, which is projected onto a screen or the like by a projection lens 1114. If video signals processed in one of the data processing circuit blocks 300 to 700 having the phase expansion function and the rotation function in accordance with the above-described embodiments are respectively supplied to the liquid crystal panels 1110R, 1110G, and 1110B, images in the corresponding colors can be formed as high-quality high-resolution images by the liquid crystal panels 1110R, 1110G, and 1110B. Therefore, a large image free from horizontal crosstalk and vertical line non-uniformity and having high resolution can be projected onto a screen or the like by using the projector 1100.

The present invention is not exclusively applied to the above-described image display apparatus arranged as a projector having transmission type liquid crystal panel. The present invention can be applied to any other video display apparatuses, e.g., a projector using a reflection type liquid crystal panel, a vehicle navigation apparatus, touch panel apparatus, a POS terminal, a video camera or a video apparatus with a monitor, a television set, a personal computer, a word processor, and a portable telephone set.

What is claimed is:

1. An image display apparatus having:

an image display unit in which pixels electrically connected to a plurality of data signal lines and to a plurality of scanning signal lines are arrayed in a matrix form; and scanning signal line selection means for supplying said scanning signal lines with scanning signals for successively selecting said scanning signal lines, said apparatus driving said pixels by applying voltages to the pixels in accordance with said data signals and said scanning signals while inverting the polarities of the voltages applied to the pixels, said apparatus comprising:

phase expansion means supplied with a first video signal having serial pixel data for driving said pixels by voltages having a first polarity, and with a second video signal having serial pixel data for driving said pixels by voltages having a second polarity, said phase expansion means forming, from said first and second video signals, m (where m is an integer equal to or larger than 2) phase-expanded signals expanded into pixel data by extending the data length of items of said pixel data corresponding to some of said pixels periodically selected, said phase expansion means outputting the phase-expanded signals to phase-expanded signal output lines in parallel with each other, wherein said phase expansion means has m sample and hold sections connected to said m phase-expanded signal output lines, said first video signal being constantly input to one of two groups of said sample and hold sections during a frame period, said second video signal being constantly input to the other group of said sample and hold sections during the frame period;

signal supply means for supplying said pixel data to said plurality of data lines on the basis of said m phase-expanded signals input via m signal supply lines;

connection change means for changing connections between said m phase-expanded signal output lines and said m signal supply lines; and change control means for controlling change of the order of expansion into said in phase-expanded signals performed by said phase expansion means, and a combination of connections changed by said connection change means by linking the combination to said expansion order, wherein said change control means performs change control so that an expansion order first set with respect to the preceding frame is changed to a different expansion order in synchronization with vertical synchronization.

2. An image display apparatus according to claim 1, wherein said change control means controls change of said expansion order between at least m expansion orders in accordance with a predetermined sequence and in synchronization with horizontal synchronization.

3. An image display apparatus according to claim 1, wherein said change control means forms said m expansion signals by alternately expanding said pixel data of said first and second video signals.

4. An image display apparatus according to claim 1, wherein said image display unit comprises a liquid crystal panel, and said signal supply means comprises a data-side drive section which supplies said pixel data to said data signal lines of said liquid crystal panel.

5. An image display apparatus according to claim 1, wherein said image display unit comprises a projection type display unit having a liquid crystal panel and a projection light source, and said signal supply means comprises a data-side drive section which supplies said pixel data to said data signal lines of said liquid crystal panel.

6. An image display apparatus having:

an image display unit in which pixels electrically connected to a plurality of data signal lines and to a plurality of scanning signal lines are arrayed in a matrix form;

scanning signal line selection means for supplying said scanning signal lines with scanning signals for successively selecting said scanning signal lines; and signal supply means for supplying pixel data signals to said plurality of data signal lines, said apparatus driving said pixels by applying voltages to the pixels in accordance with said data signals and said scanning signals while inverting the polarities of the voltages applied to the pixels, said apparatus comprising:

first phase expansion means supplied with a digital signal having pixel data of a first data length corresponding to the position of each of said pixels, said first phase expansion means outputting two phase-expanded digital signals in which items of said pixel data corresponding to some of said pixels periodically selected are expanded into pixel data having a data length n (where n is an integer equal to or larger than 2) times longer than said first data length;

first and second branching means respectively supplied with said phase-expanded digital signals, each of said first and second branching means branching a route for the phase-expanded digital signal into a first route on which the polarity of the digital signal is not inverted and a second route on which the polarity of the digital signal is inverted by polarity inversion means;

first selection means for selecting one of said first and second routes branched by said first branching means;

second selection means for selecting one of said first and second routes branched by said second branching means; and first and second digital-to-analog conversion means for respectively analog-to-digital converting the two phase-expanded digital signals selected by said first and second selection means to output two first phase-expanded analog signals, wherein said signal supply means supplies said pixel data signals to said data signal lines on the basis of said two first phase-expanded analog signals.

7. An image display apparatus according to claim 6, further comprising:

second phase expansion means for forming, from said two first phase-expanded analog signals, n X N (N: an integer) second phase-expanded analog signals expanded into pixel data by extending the data length of items of said pixel data corresponding to some of said pixels periodically selected, said second phase expansion means outputting the second phase-expanded analog signals to n X N phase-expanded signal output lines in parallel with each other, wherein said signal supply means supplies said pixel data signals to said data signal lines on the basis of said n X N second phase-expanded analog signals.

8. An image display apparatus according to claim 7, wherein said signal supply means supplies said pixel data to said plurality of data signal lines on the basis of said n X N second phase-expanded analog signals input through n X N signal supply lines, said image display apparatus further comprising:

connection change means for changing connections between said n X N phase-expanded signal output line and said n X N signal supply lines; and change control means for controlling change of the order of phase expansion performed by each of said first and second phase expansion means, and a combination of connections changed by said connection change means by linking the combination to said phase expansion order.

9. An image display apparatus according to claim 6, wherein a first-polarity gamma correction circuit and a first-polarity clamp circuit are connected in a stage subsequent to said first digital-to-analog conversion means, and wherein a second-polarity gamma correction circuit and a second-polarity clamp circuit are connected in a stage subsequent to said second digital-to-analog conversion means.

10. An image display apparatus according to claim 6, wherein said change control means controls said first and second phase expansion means and said connection change means by selecting at least one of predetermined n X N phase expansion orders for said first and second phase expansion means, and by also selecting one of a plurality of predetermined combinations of connections as the combination of connections changed by said connection change means.

11. An image display apparatus according to claim 6, wherein said change control means controls change of the order of phase expansion performed by said first and second phase expansion means and the combination of connections changed by said connection change means so that the voltages applied to said pixels differ in polarity one from another with respect to the pixels connected in common to each of said scanning signal lines.

12. An image display apparatus according to claim 6, wherein said change control means controls change of the order of phase expansion performed by said first and second phase expansion means and the combination of connections changed by said connection change means so that the voltages applied to said pixels are changed in polarity one from another in synchronization with a horizontal synchronization signal with respect to the pixels connected in common to each of said data lines.

13. An image display apparatus according to claim 6, wherein said change control means controls change of the order of phase expansion performed by said first and second phase expansion means and the combination of connections changed by said connection change means so that said data sampling section in which data of the leading pixel of one frame is sampled is changed with respect to frames in synchronization with a vertical synchronization signal.

14. An image display apparatus having:

an image display unit in which pixels electrically connected to a plurality of data signal lines and to a plurality of scanning signal lines are arrayed in a matrix form;

scanning signal line selection means for supplying said scanning signal lines with scanning signals for successively selecting said scanning signal lines; and signal supply means for supplying pixel data signals to said plurality of data signal lines, said apparatus driving said pixels by applying voltages to the pixels in accordance with said data signals and said scanning signals while inverting the polarities of the voltages applied to the pixels, said apparatus comprising:

first phase expansion means supplied with a digital signal having pixel data of a first data length corresponding to the position of each of said pixels, said first phase expansion means outputting two phase-expanded digital signals in which items of said pixel data corresponding to some of said pixels periodically selected are expanded into pixel data having a data length n (where n is an integer equal to or larger than 2) times longer than said first data length;

polarity determination means supplied with said two phase-expanded digital signals, said polarity determination means determining the polarities of said two phase-expanded digital signals by leading one of said phase-expanded digital signals to a first route on which the polarity of the digital signal is not inverted and leading the other of said phase-expanded digital signals to a second route on which the polarity of the digital signal is inverted by polarity inversion means;

first and second digital-to-analog conversion means for respectively analog-to-digital converting said two phase-expanded digital signals having the determined polarities to output two first phase-expanded analog signals, wherein said signal supply means supplies said pixel data signals to said data signal lines on the basis of said two first phase-expanded analog signals.

* * * * *

UNITED STATES PATENT AND TRADEMARK OFFICE

CERTIFICATE OF CORRECTION

PATENT NO. : 6,144,354
DATED : November 7, 2000
INVENTOR(S) : Fumio Koyama; Keijiro Naito and Kiyoshi Miyashita It is certified that error appears in the above-identified patent and that said Letters Patent is hereby corrected as shown below:

Title page,
After "PCT Pub. Date: Dec. 24, 1997", on the next line, please add
-- [30] Foreign Application Priority Data
June 20, 1996 [JP] Japanese Pat. Off. .....8-179920 --

Signed and Sealed this

Twenty-third Day of October, 2001

*Attest:*

Nicholas P. Godici

NICHOLAS P. GODICI
*Acting Director of the United States Patent and Trademark Office*

*Attesting Officer*